US006068711A

United States Patent [19]

Lu et al.

[11] Patent Number: 6,068,711

[45] Date of Patent: May 30, 2000

[54] METHOD OF INCREASING CORROSION RESISTANCE OF METALS AND ALLOYS BY TREATMENT WITH RARE EARTH ELEMENTS

[75] Inventors: Yucheng Lu, Dundas; Michael Brian Ives, Burlington, both of Canada

[73] Assignee: McMaster University, Hamilton, Canada

[21] Appl. No.: 08/863,935

[22] Filed: May 27, 1997

Related U.S. Application Data

[63] Continuation-in-part of application No. 08/541,972, Oct. 10, 1995.

[30] Foreign Application Priority Data

Oct. 7, 1994 [GB] United Kingdom ..... 9420295

[51] Int. Cl.[7] ..... C23C 22/48

[52] U.S. Cl. ..... 148/273; 148/275

[58] Field of Search ..... 148/272, 273, 148/275

[56] References Cited

U.S. PATENT DOCUMENTS

| | | | |
|---|---|---|---|
| 5,019,555 | 5/1991 | Chin et al. | 505/1 |
| 5,192,374 | 3/1993 | Kindler . | |
| 5,194,138 | 3/1993 | Mansfeld et al. . | |
| 5,221,371 | 6/1993 | Miller . | |
| 5,356,492 | 10/1994 | Miller . | |
| 5,362,335 | 11/1994 | Rungta . | |

FOREIGN PATENT DOCUMENTS

| | | |
|---|---|---|
| 0331284 | 1/1989 | European Pat. Off. . |
| 0367504 | 10/1989 | European Pat. Off. . |
| WO8806639 | 9/1988 | WIPO . |
| WO9508008 | 3/1995 | WIPO . |

OTHER PUBLICATIONS

DC and AC Passivation of Aluminum Alloys, H. Shih, Y. Wang and F. Mansfeld, Corrosion 91, The NACE Publications Dept., P. O. Box 218340, Houston, TX 77219, The NACE Annual Conference and Corrosion Show, Mar. 11–15, 1991, Cincinnati Convention Center, Cincinnati, Ohio, Paper No. 136, pp. 1–12.

(List continued on next page.)

*Primary Examiner*—Prince Willis
*Assistant Examiner*—Andrew L. Oltmans
*Attorney, Agent, or Firm*—Lynn C. Schumacher; Hill & Schumacher

[57] ABSTRACT

There is provided a method for treating the surface of metals such as nickel based or high alloy steels, austenitic and ferritic stainless steels, copper and aluminum alloys to increase their corrosion resistance by modification of the metal surfaces to inhibit cathodic corrosion processes. In a single step treatment process the metals are immersed into a heated aqueous composition containing a rare earth salt substantially free of any halide compound. Increased corrosion resistance is obtained using nitrates of yttrium, gadolinium, cerium, europium, terbium, samarium, neodymium, praseodymium, lanthanum, holmium, ytterbium, dysprosium, and erbium nitrates. The rare earth salt is present in the range from about 2% by weight to saturation of the solution. The composition includes a pH-modifying substance such as nitric acid to adjust the pH in the range 0.5 to about 6.5 to attack the surface to remove oxides facilitating deposition of the rare earth. For aluminum alloys the pH is maintained between 4.5 to 6.5, for nickel based alloys and austenitic stainless steels the pH is maintained between 0.5 to 3.5 and between pH 2.0 to 4.5 for ferritic stainless steels. The surface can also be conditioned by abrasion before or during immersion in the composition. Increased corrosion resistance is achieved by immersion for time periods in the range of a few minutes up to one hour with the composition maintained between 60 to 95° C. Cerium, gadolinium, neodymium and praseodymium nitrate when used alone produced the greatest degree of corrosion resistance compared to the other rare earth nitrates. Significant synergistic effects are observed when combinations of two or more rare earth nitrates are used in the compositions. Aqueous treatment solutions based on combinations of cerium nitrate, gadolinium nitrate and lanthanum nitrate are very effective in reducing crevice corrosion.

36 Claims, 14 Drawing Sheets

OTHER PUBLICATIONS

Cationic–Film–Forming Inhibitors for the Protection of the AA 7075 Aluminum Alloy Against Corrosion in Aqueous Chloride Solution, D. R. Arnott, B.R.W. Hinton and N.E. Ryan, Corrision Scient, Jan. 1989, vol. 45, No. 1, pp. 12–18.

Pitting and Passivation of AL Alloys and AL–Based Metal Matrix Composites, F. Mansfeld, S. Lin, S. Kim, H. Shih, Corrision and Environmental Effects Laboratory, Department of Materials Science Engineering, University of Southern California, Los Angeles, California 90089–0241, J. Electrochem, So., vol. 137, No. 1, Jan. 1990, The Electrochemical Society, Inc., pp. 78–82.

Development of "Stainless Aluminum", F. Mansfeld, V. Wang, and H. Shih, Corrosion and Environmental Effects Laboratory, Department of Materials Science and Engineering, University of Southern California, Los Angeles, California 90089–0241, J. Electrochem, So., vol. 138, No. 12, Dec. 1991, The Electrochemical Society, Inc., pp. 78–82.

METHOD OF INCREASING CORROSION RESISTANCE OF METALS AND ALLOYS BY TREATMENT WITH RARE EARTH ELEMENTS

CROSS REFERENCE TO RELATED PATENT APPLICATIONS

This patent application is a continuation-in-part patent application of U.S. patent application Ser. No. 08/541,972 filed on Oct. 10, 1995 entitled METHOD OF INCREASING CORROSION RESISTANCE OF METALS AND ALLOYS BY TREATMENT WITH RARE EARTH ELEMENTS, which is now abandoned.

FIELD OF THE INVENTION

The present invention relates to a process of increasing corrosion resistance of metals and alloys by surface treatment with one or more elements from the rare earth group of elements. More particularly, the present invention provides a method of increasing corrosion resistance of metals such as stainless steels, nickel based alloys, aluminum alloys and copper alloys by treatment in a solution of rare earth salts.

BACKGROUND OF THE INVENTION

Highly alloyed stainless steels and nickel based alloys are now utilized in environments which produce significant localized corrosion in many other metals and alloys. The excellent pitting corrosion resistance of these highly alloyed stainless steels and nickel based alloys is due to the high alloy composition, which is believed to inhibit the anodic corrosion processes. Of the beneficial alloying elements in stainless steels, chromium is the most important because it forms a bipolar passive film, see A. R. Brooks, C. R. Clayton, K. Doss and Y. C. Lu, *J. Electrochem. Soc.,* Vol. 133, 2459, (1986). To date, the alloy development approach has been to increase the amount of alloyed chromium, molybdenum and nitrogen in order to improve pitting corrosion resistance. However, crevice corrosion remains a problem in these alloys. For example, it can be manifest as under-deposit corrosion, as has been found in recent ocean tests even in steels with high molybdenum and chromium contents, see M. B. Ives, in Proceedings "Applications of Stainless Steels '92", *Jemkontoret,* Stockholm, 436 (1992).

The major difference between crevice and pitting corrosion involves the initiation stages. Crevice corrosion in aerated solutions involves an oxygen concentration cell. Furthermore, in the later stages of localized corrosion development, cathodic reduction of the depolarizers on the large areas surrounding the attacked site is necessary to support the high rate of anodic dissolution. It has been disclosed by Y. C. Lu, J. L. Luo and M. B. Ives, *ISIJ International,* Vol. 31, 210 (1991), that the enhanced cathodic reduction of oxidant adjacent to a localized attack site produces an increase of localized corrosion. Thus a powerful means of preventing crevice corrosion would be to constrain or significantly inhibit the cathodic reactions such as oxygen reduction, hydrogen evolution and the like.

It has been previously reported that cerium ion-implantation in UNS S31603 stainless steels effectively inhibits the reduction of oxygen and protons, reducing the rate by more than two orders of magnitude, see Y. C. Lu and M. B. Ives, *Corrosion Sci.,* Vol. 34, 11, 1773 (1993). Also, the anodic (passive) current density is reduced by more than one order of magnitude for UNS S31603 stainless steel after cerium implantation. Consequently, cerium ion implantation improves the crevice corrosion resistance of UNS S31603 stainless steel as determined by both anodic polarization in aerated 0.1 M $Na_2SO_4$+0.6 M NaCl solution and by the ASTM G48 B crevice test in 10% ferric chloride hexahydrate solution. However, ion-implantation is not readily amenable to economically treating large surface areas materials. Further, ion-implantation may induce radiation damage at the surface of the metal or alloy which may have detrimental structural effects so that ion-implantation has practical limitations.

The nickel based alloys and high alloy stainless alloys are most frequently used in specific aggressive aqueous corrosion environments. These alloys can benefit considerably from enhanced corrosion resistance by controlling the cathodic reaction rates. However, more commonly used alloys in industrial applications such as 18-8 stainless, UNS S30400 or the Mo containing alloy, UNS S31603, can also benefit from the effects of reduced cathodic reaction rates. The ferritic stainless steels, which are the least corrosion resistant of the stainless family, would advantageously benefit from increased corrosion resistance by any mechanism. A common component in these alloys is the presence of a passive layer.

Aluminum and aluminum alloys, although extremely different in structure than the ferrous and nickel alloys, also possess passive layers and would benefit from increase corrosion inhibition. Corrosion and corrosion induced failure is a major problem associated with aluminum alloys. Aluminum alloys are widely used in corrosive environments, for example in automotive applications such as brazed aluminum heat exchangers, coolers, evaporators, radiators and the like. Known methods of corrosion protection of aluminum and aluminum alloys involve the use of chromate ions to form conversion coatings on the alloys. Environmental concerns associated with chromate ions are a drawback to widespread use of this technique. Other strategies for increasing corrosion resistance of aluminum based alloys based on physical deposition methods such as sputtering are inherently limited since the area being coated is by line-of-sight from the source.

Cerium containing solution treatment has been effective in improving the localized corrosion resistance of aluminum alloys. For example, it has previously been reported that chemical passivation of aluminum alloys immersed in cerium chloride solutions for 7 days or longer produces a conversion coating on the aluminum alloy exhibiting increased corrosion resistance, see F. Mansfield, S. Lin, S. Kim and H. Shih, *J. Electrochem. Soc.,* Vol. 137, 78 (1990). In order to speed up the production of the conversion coating, the aluminum alloys have been dipped into hot cerium salt solutions followed by direct current (DC) anodic polarization in a molybdate solution to produce an anodized passive layer containing Ce and Mo as disclosed in F. Mansfield, V. Wang and H. Shih, *J. Electrochem. Soc.,* Vol. 138, L74 (1991). Alternating current (AC) passivation of aluminum alloys in the same types of cerium salt solutions has also been used to form anodized layers exhibiting corrosion resistance as disclosed in H. Shih, V. Wang and F. Mansfield, *Corrosion* 91, Paper #136, NACE, Houston (1991). The use of rare earth metal chlorides as inhibitors for aluminum alloys in NaCl has been disclosed in D. R. Arnott, B. R. W. Hinton and N. E. Ryan, Corrosion, Vol. 45, 12 (1989).

U.S. Pat. No. 5,194,138 issued to Mansfeld is directed to a multi-step process for forming a corrosion resistant aluminum surface coating by exposure first to a cerium nonhalide solution followed by exposure to an aqueous cerium halide (chloride) solution. The purpose of this multi-step treatment process is to grow or continue to grow, in successive steps, a uniform, non-porous thick protective oxide coating to protect the Al surface against anodic attack causing pitting corrosion. This patent also teaches exposing the aluminum surface to molybdenum solutions and electrochemically positively charging the surfaces into the passive region to provide an anodically grown oxide coating. Regardless, the essence of this process is to produce an improved barrier oxide layer by precipitation of Ce (or Ce and Mo) in the growing oxide film to reduce porosity and increase electrical resistivity in the chemically or electrochemically formed films. A drawback to this method is the length of time required to grow a sufficiently thick oxide coating, i.e on the order of hours, and the fact that the efficacy of the thick protective coating depends in part on its uniformity. Achievement of the necessary uniformity presents practical limitations in terms of process treatment rate, or process controls.

U.S. Pat. No. 5,221,371 issued to Miller discloses non-toxic corrosion resistance conversion coatings for aluminum and Al alloys. The process is a multi step process using acidic solutions comprising cerium chloride and potassium permanganate alone or in combination with strontium chloride. U.S. Pat. No. 5,356,492 issued to Miller is very similar to '371 but substitutes hydrogen peroxide for potassium permanganate.

Patent publication WO-A-95/08008 is directed to a cleaning solution for use in a multi-step method for chemically cleaning surfaces of aluminum and its alloys. The method provides a means of pre-treating Al alloy surfaces prior to application of other coatings such as paint layers and the like.

U.S. Pat. No. 5,362,335 issued to Rungta discloses a four step process directed to forming a corrosion resistant surface on aluminum alloys only using cerous chlorides solutions. A bohmite film is first formed on the aluminum alloy surface after which the bohmite coated sample is then subjected to a drying step at about 200° F.

For the foregoing reasons, there has been a need for a simple, inexpensive, and rapid surface treatment for increasing the corrosion resistance of industrially important metals and alloys such as copper and copper alloys, chromium, molybdenum, ferritic and austenitic stainless steels, nickel based alloys, aluminum alloys and the like which is rapid and environmentally safe.

SUMMARY OF THE INVENTION

It is an object of the present invention to provide a method for increasing corrosion resistance of metals and alloys that is rapid, economical and can be used for several different metals or alloys.

An advantage of the present invention is that it provides a method of treating the surface of the metal or alloy to produce corrosion inhibition that relies upon modification of the surface of the metal or alloy that does not require growth of a thick uniform protective oxide coating. Another advantage of the present method is that it involves a one step exposure to a treatment solution for periods of time ranging from a minute up to an hour.

The present invention provides compositions and a method for increasing the corrosion resistance of metals and alloys by exposing the surface of the metals to the compositions. The compositions may be used to treat chromium, molybdenum, a range of austenitic and ferritic stainless steels, nickel and nickel based alloys, aluminum and aluminum alloys, copper, copper alloys and the like to improve the localized corrosion resistance of the alloys. The corrosion behavior of treated and untreated samples has been compared using a combination of electrochemical measurement techniques in an aerated 0.6M NaCl+0.1M $Na_2SO_4$ solution, corrosion tests and field tests in natural seawater. Surface analysis has been used to determine the chemical composition of the films formed on the treated surfaces in order to elucidate the mechanism of the enhanced corrosion-resistance. The surface analysis and electrochemical studies indicate the surface of the alloys is modified upon exposure to the compositions and exhibits improved resistance to localized corrosion and especially crevice corrosion resistance in chloride containing media. The effect is very appreciable for the crevice corrosion resistance of austenitic stainless steels and nickel based alloys in sea water or chlorinated seawater.

The present invention provides a method of treating a surface of aluminum and alloys thereof to increase corrosion resistance by modification of the surface to inhibit cathodic processes. The method comprises providing an aqueous solution comprising a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 4.5 to an upper solubility limit of the rare earth element in the aqueous solution as a function of pH. The method includes exposing a surface of the aluminum or alloy thereof to the aqueous solution, in a single step treatment, for an effective period of time and with the solution being at an effective temperature to modify the surface to inhibit cathodic processes but not to purposefully grow a thick protective oxide coating thereon.

In this aspect of the invention the at least one rare earth salt is present in an amount of from about 2% by weight to saturation.

In another aspect of the invention there is provided a method of treating a surface of aluminum and alloys thereof to increase corrosion resistance by modification of the surface to inhibit cathodic processes consisting essentially of providing an aqueous solution comprising dissolved aluminum and a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 4.5 to an upper solubility limit of the rare earth element in the aqueous solution as a function of pH. The method includes exposing a surface of the aluminum or alloy thereof to the aqueous solution, in a single step treatment, for an effective period of time and with the solution being at an effective temperature to modify the surface to inhibit cathodic processes but not to purposefully grow a thick protective oxide coating thereon.

In another aspect of the invention there is provided a method of treating a surface of stainless steels, nickel alloys, copper and copper alloys to increase corrosion resistance by modification of the surface to inhibit cathodic processes. The method comprises providing an aqueous solution comprising a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 0.5 to an upper solubility limit of the rare earth element in the aqueous solution as a function of pH. The method includes chemically treating the surface of the metal or alloy by exposing the surface to the aqueous solution in a single step exposure for an effective period of time with the solution being at an effective temperature to modify the surface to inhibit cathodic processes.

In another aspect of the invention there is provided a method of treating stainless steels, nickel based alloys, copper and copper alloys to increase corrosion resistance comprising providing an aqueous solution comprising a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 0.5 to an upper solubility limit of the rare earth element in the aqueous solution as a function of pH. The method includes conditioning a surface of the metal or alloy by mechanically abrading the surface; and chemically treating the surface of the metal or alloy by exposing the surface to the aqueous solution in a single step treatment for an effective period of time and with the solution being at an effective temperature to modify the surface to inhibit cathodic processes.

BRIEF DESCRIPTION OF THE DRAWINGS

The method of increasing corrosion resistance of metals and alloys by treatment with compositions containing rare earth elements in accordance with the present invention will now be described, by example only, reference being had to the accompanying drawings, in which.

DETAILED DESCRIPTION OF THE INVENTION

The following description of the method of increasing corrosion resistance of metals and alloys will first describe the treatment of various stainless steels using compositions containing only one rare earth salt, followed by a description of the treatment of various stainless steel alloys, nickel, nickel based alloys, aluminum alloys, chromium, iron and copper alloys using compositions comprising more than one rare earth element.

As used herein, the term rare earth element refers to the lanthanide series of elements in the periodic table with proton numbers ranging from cerium (58) to lutetium (71) inclusive. Lanthanum, yttrium and scandium, while not technically lanthanides because they do not have f-orbital electrons, are chemically very similar to the lanthanides and accordingly are also considered rare earth elements herein. While the term rare earths specifically refers to the oxides of the rare earth elements, it is used more generally to refer to this particular group of elements both in chemical practice and hereinafter.

Figure 4:
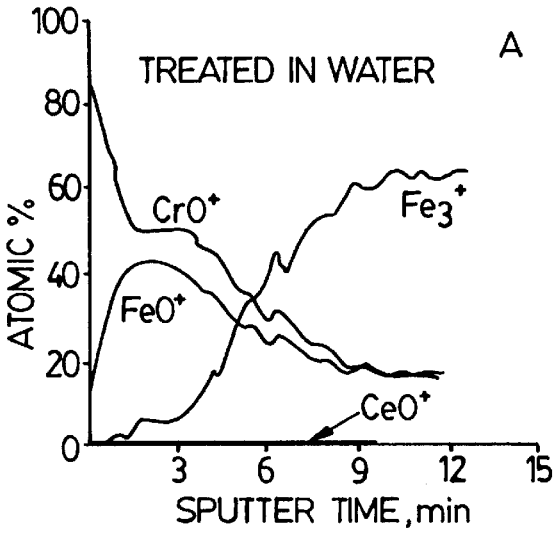
FIG. 4 shows SIMS profiles from UNS S31603 stainless steel samples treated at 95±2° C. for 1 hour in distilled water.
Figure 5:
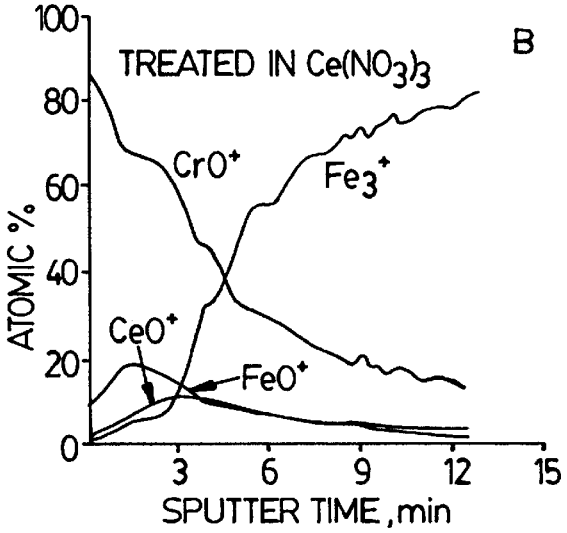
FIG. 5 shows SIMS profiles from UNS S31603 stainless steel samples treated at 95±2° C. for 1 hour in 0.05 M cerium nitrate.

A) Corrosion Inhibition By Treatment With Individual Rare Earth Elements i) Cerium Containing Solutions The ferrous alloy samples of Table I were electrochemically characterized using potentiodynamic and galvanostatic methods which illustrate the beneficial effects of rare earth treatment. In addition, alloy UNS S31603 was subjected to compositional surface analysis and results from this study are shown in FIGS. 4 5.

Figure 2:
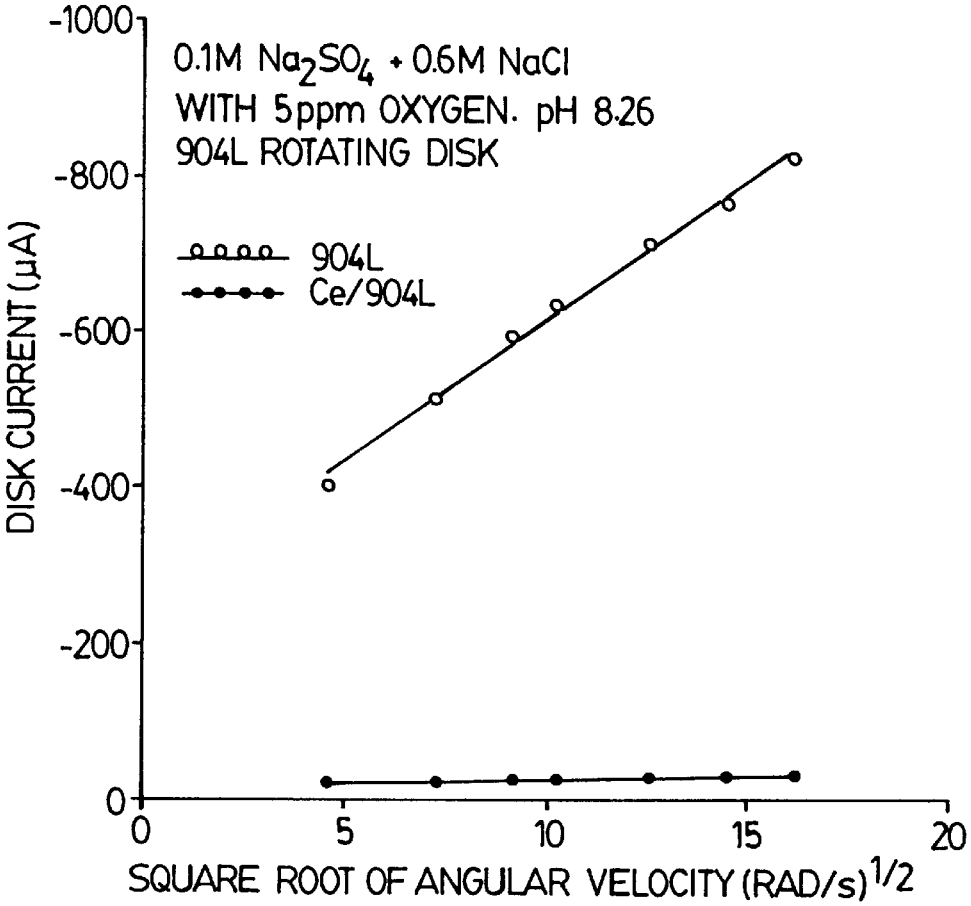
FIG. 2 displays disc current measured from FIG. 1 at −950 mV vs. the square root of the angular velocity of the rotating discs.

FIG. 2 shows the disc current, measured from UNS N08904 discs at −950 mV, as a function of the square root of disc angular velocity. The straight line fit of the data indicates the reduction of oxygen on the untreated stainless steel is mass transport limited. However, the current measured on the cerium-treated UNS N08904 steel was greatly reduced and did not depend significantly on rotation speed. The data show clearly that the cathodic electrode reaction is inhibited by the cerium nitrate treatment.

Figure 3:
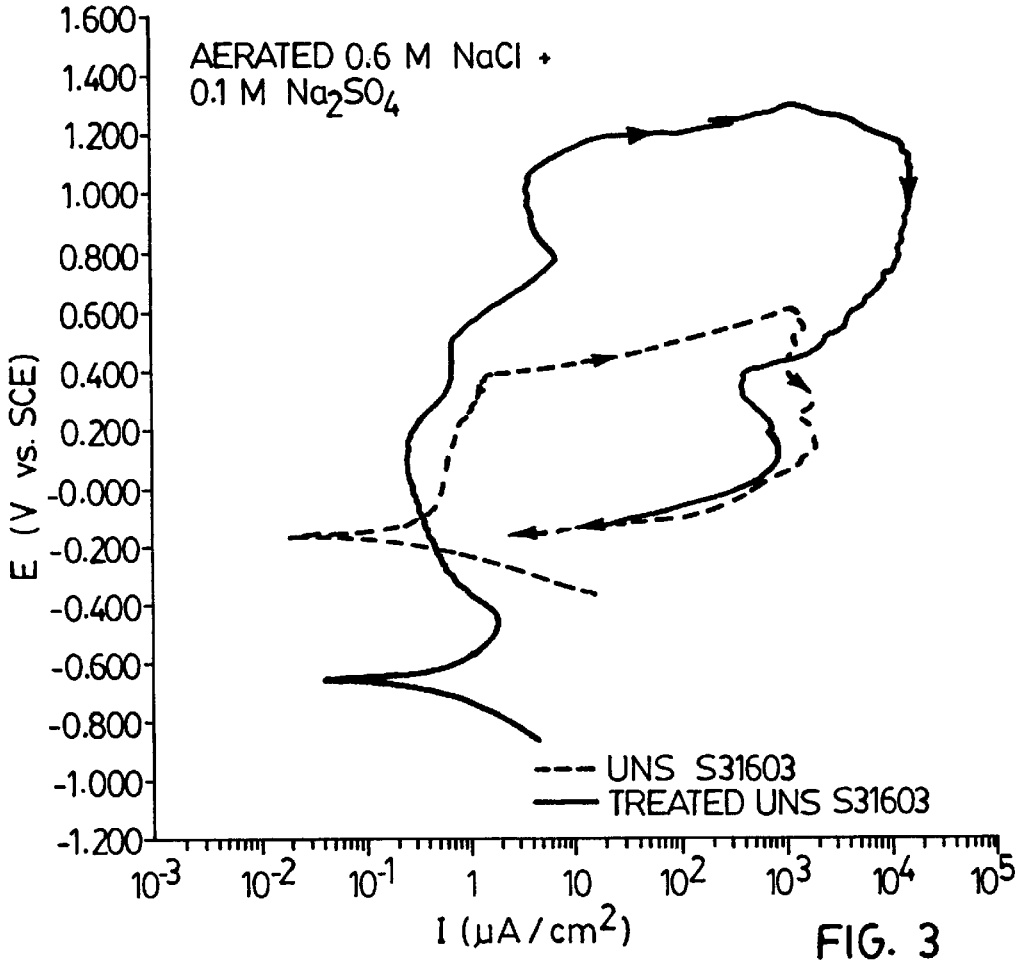
FIG. 3 displays the potentiodynamic polarization curves of treated and untreated UNS S31603 steel in aerated solution at pH 8.26.

The cerium pretreatment was also found to influence the anodic characteristics of these stainless steels. In FIG. 3, the anodic polarization of untreated and treated UNS S31603 steel are compared. In addition to the cathodic inhibition which shifted the open circuit potential by about 480 mV, the passive range was extended greatly by cerium treatment. The breakdown potential has been raised about 800 mV. The passive current density was also reduced significantly. This result indicates that the cerium treatment also stabilizes passivity and inhibits breakdown.

Auger electron spectroscopy (AES) and secondary ion mass spectroscopy (SIMS) profiles showed that the Cr/Fe ratio of the surface film formed on cerium-treated UNS S31603 was about twice that of the same steel treated in distilled water at the same temperature. This is illustrated by comparing the SIMS profiles in FIGS. 4 and 5, which also indicate that cerium is present in the oxide film on the treated steel. The increased concentration of chromium in the surface region suggests an important effect of cerium treatment on the improved stability of the passive film. The distribution of cerium over the surface was however not uniform (data not shown).

X-ray photoelectron spectroscopy (XPS) has previously been used to help identify the chemical state of the cerium present on treated surfaces. The position of the $3d^{5/2}$ peak was determined to be ≈888 eV, which compares with values for a $Ce(NO_3)_3$ standard of ≈889 eV, and a $CeO_2$ standard of ≈882 eV (data not shown). Clearly the cerium was present in a trivalent form. A very small amount of nitrogen was also detected by XPS analysis on cerium treated steel, and its peak position (≈401 eV) may suggest the presence of $NO^-$ rather than nitrate (408 eV) or nitride (397 eV). The oxygen spectrum showed both $O^{-2}$ and $OH^-$ signals of about equal intensity. The above results suggest that cerium may form $Ce^{3+}$ complexes or oxy-hydroxide in the surface of the treated steels.

Further evidence for the ability of a non-uniform distribution of cerium to significantly inhibit the cathodic reaction processes has been provided by direct evidence that the

TABLE I

Composition of Stainless Steels Used in This Study (wt %)

| Alloy | Element | | | | | | | | | | | |
|---|---|---|---|---|---|---|---|---|---|---|---|---|
| | Cr | Ni | Mo | Cu | Mn | C | N | P | S | Si | Ti | Cb* |
| UNS S40900 | 10.5–11.75 | 0.5 | — | — | 1.0 | .08 | — | .045 | .045 | 1 | 6XC to 0.75 Max | — |
| UNS S41045 | 12–13 | 0.5 | — | — | 1.0 | .03 | .03 | .04 | .03 | 1 | — | 9X(C + N) min, to 0.6 Max |
| UNS S31603 | 16–18 | 10–14 | 2–3 | — | 2.0 | .03 | — | .045 | .03 | 1 | — | — |
| UNS N08904 | 19–23 | 23–28 | 4–5 | 1–2 | 2.0 | .02 | — | .045 | .035 | 1 | — | — |

*Columbium also known as Niobium

Note: All values shown as wt %. Unless indicated as a range, all values shown are maximum concentrations.

Figure 1:
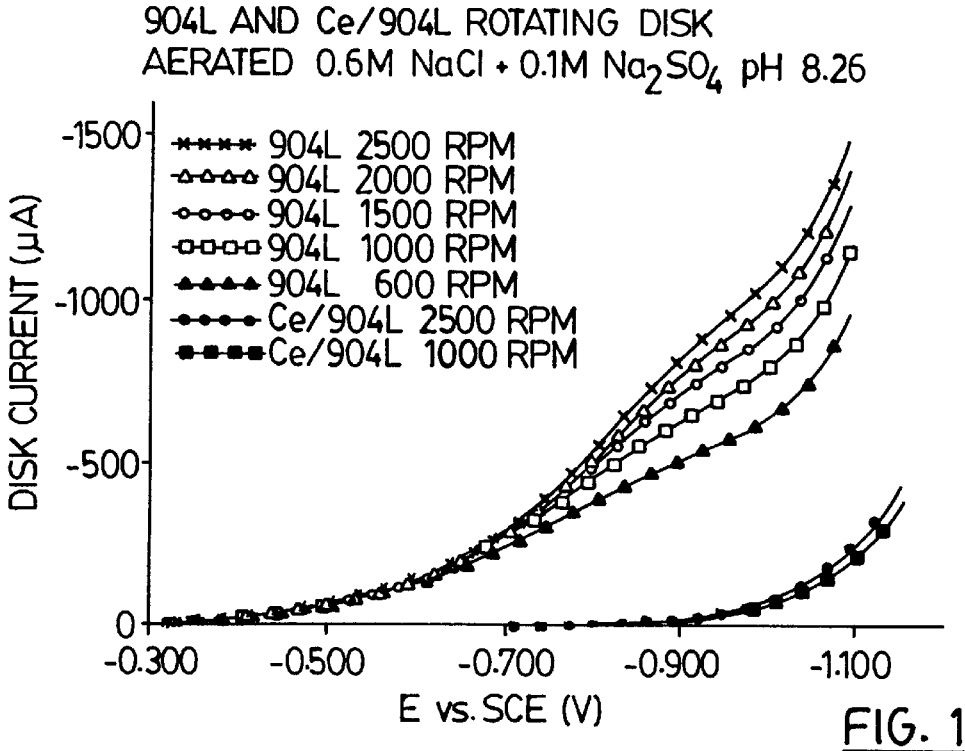
FIG. 1 is a plot of disc current vs. potential for both treated (0.05M $Ce(NO_3)_3 6H_2O$ at 90–95° C. for 1 hour) and untreated UNS N08904 stainless steel discs in aerated 0.1 M $Na_2SO_4$+0.6 M NaCl solution at pH 8.26.

FIG. 1 shows the disc current vs. potential for UNS N08904 stainless steel discs, before and after exposure to a cerium nitrate containing composition, cathodically polarized in an aerated 0.1 M $Na_2SO_4$+0.6 M NaCl solution (pH=8.26) at different disc rotation speeds. The data indicates that for the untreated UNS N08904 disc the cathodic current is rotation-speed dependent. The cathodic reaction rates, i.e. cathodic currents on the cerium-treated electrodes are shifted to more negative potentials and are greatly restrained. The current for oxygen reduction does not apparently depend on rotation speed.

cathodic sites are themselves not uniformly distributed. A modified crevice test was performed on UNS S40900 stainless steel immersed in a copper-containing solution of 0.5% $FeCl_3.6H_2O$+0.5% $CuCl_2.2H_2O$ at 22° C. The corrosive attack on the treated steel was observed to be much lighter than on the untreated one. But in addition copper nodules were deposited on the exposed areas surrounding the crevice sites. These are caused by cathodic reduction from cupric ion to metallic copper, indicating that the cathodic reactions do not take place on the entire surface uniformly. Since the cerium is likewise non-uniformly deposited, it is attractive to account for its inhibition effectiveness through the formation of $Ce^{3+}$ complexes or oxy-hydroxide which block the dispersed active cathodic reaction sites.

Similar studies were conducted to determine the efficacy of cerium treatment on pure iron, nickel, molybdenum and chromium. Cerium treatment of iron did not result in an observable improvement in corrosion resistance of the iron, based upon comparison of galvanostatic and potentiodynamic scans on treated and untreated samples (data not shown).

Treatment of pure nickel did result in an increase in corrosion resistance determined from a comparison of galvanostatic and potentiodynamic scans on treated and untreated samples (data not shown).

Treatment of molybdenum and chromium samples in cerium nitrate containing compositions resulted in a significant increase in corrosion resistance for both metals (data not shown) with molybdenum exhibiting a greater degree of corrosion resistance than chromium.

The role of the cerium treatment with metals or alloys with chromium present appears to be to produce a surface region enriched with chromium with the cerium oxide/oxyhydroxide blocking the active, or catalytic sites for cathodic reduction. Traditional passive layer growth techniques such as conversion coatings or anodizing frequently focus on decreasing charge transfer by establishing a barrier layer to electrons.

ii) Other Rare Earth Element Solutions

Figure 6:
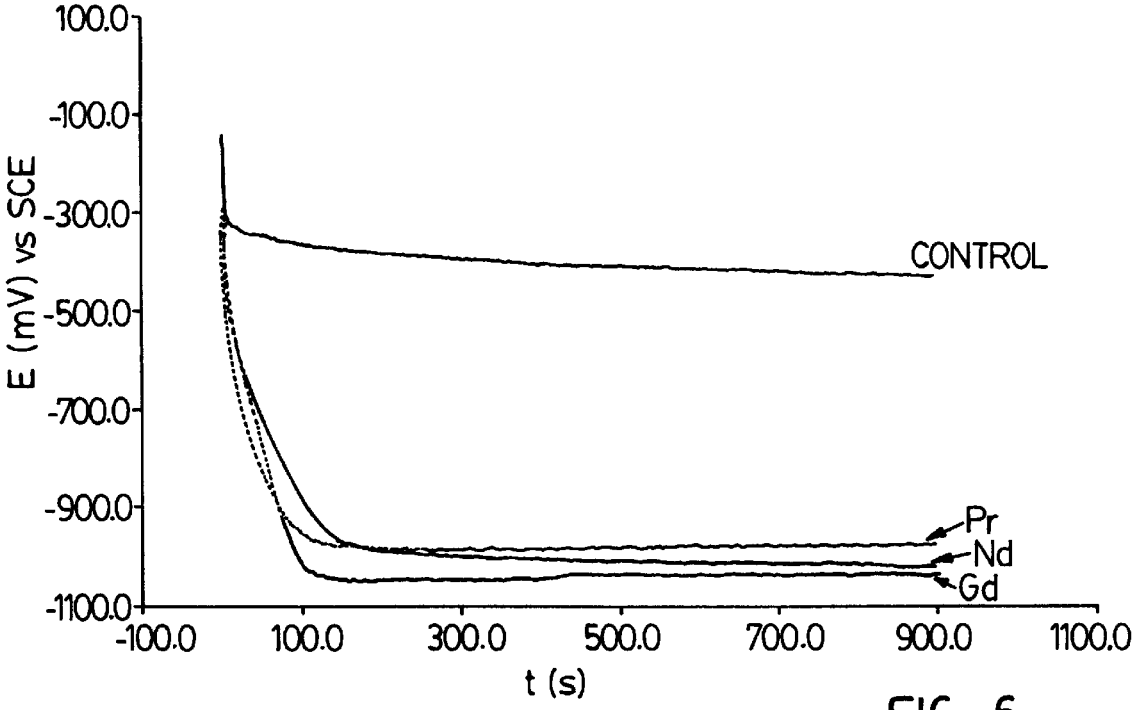
FIG. 6 shows galvanostatic polarization curves of UNS S40900 samples before and after treatment in 0.1 M gadolinium nitrate, neodymium nitrate and praseodymium nitrate at 85° C. for 20 minutes.
Figure 7:
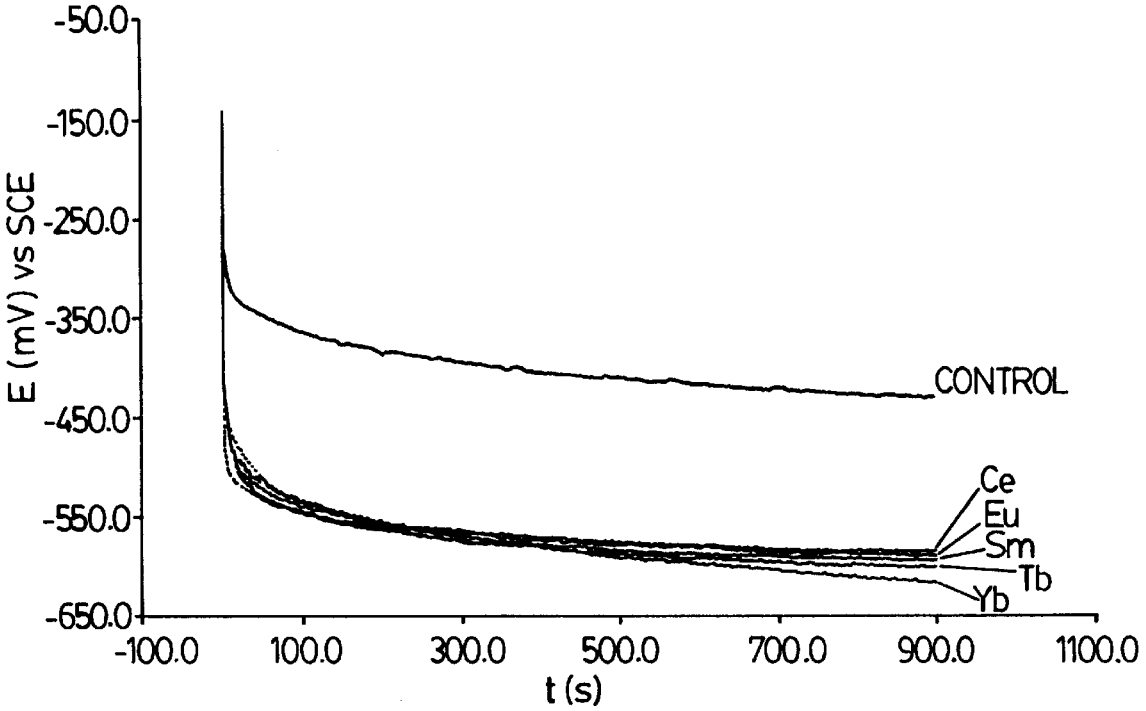
FIG. 7 shows galvanostatic polarization curves of UNS S40900 samples before and after treatment in 0.1 M cerium, europium, samarium, terbium and ytterbium nitrate at 85° C. for 20 minutes.
Figure 8:
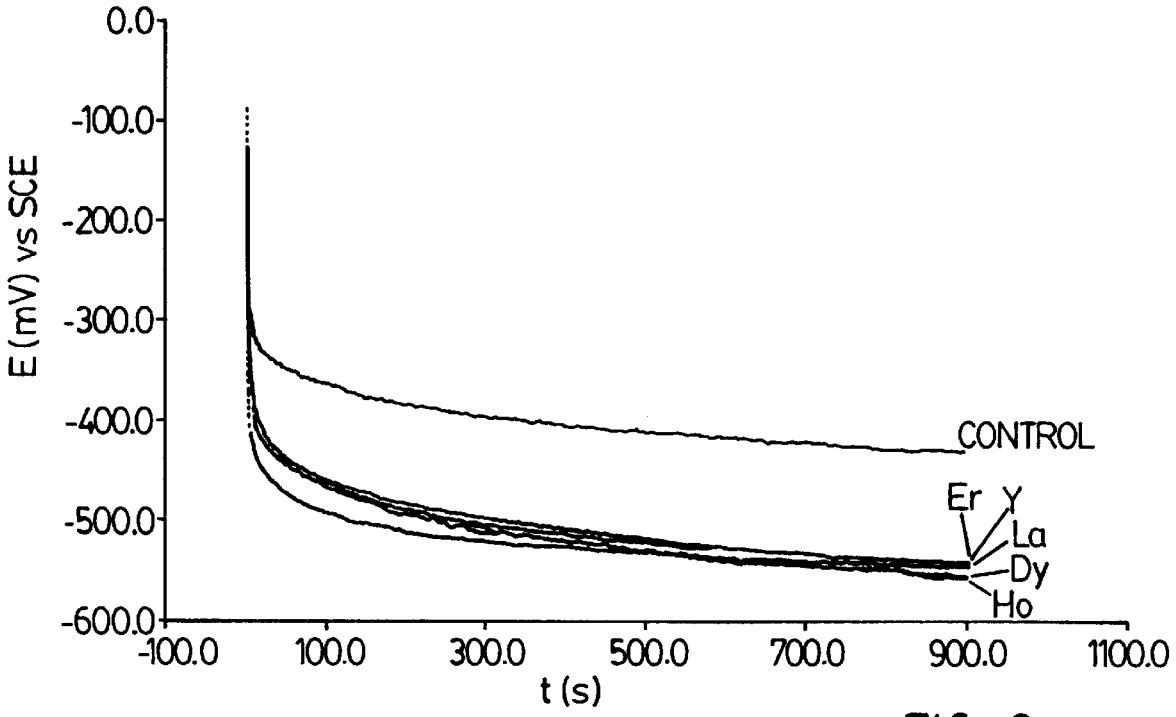
FIG. 8 shows galvanostatic polarization curves of UNS S40900 samples before and after treatment in 0.1 M erbium, yttrium, lanthanum, dysprosium and holmium nitrate at 85° C. for 20 minutes.

Referring to FIGS. 6 through 8, galvanostatic polarization curves are displayed for UNS S40900 samples before (control) and after treatment in solutions containing the indicated rare earth species. Specifically, the UNS S40900 samples were treated in 0.1M concentrations of eleven different rare earth salts. The UNS S40900 samples were dipped in the different lanthanide nitrate solutions at 85° C. for about 20 minutes. The samples were galvanostatically polarized in aerated 0.6M NaCl+0.1M $Na_2SO_4$ solution at a current density of −10 $\mu A/cm^2$. The steady state potential reached for each sample, referred to herein as $E_{Final}$, was used as an indicator of the degree of cathodic inhibition produced by each treatment.

Referring to FIG. 6, the $E_{Final}$ for samples treated in 0.1 M gadolinium nitrate, neodymium nitrate and praseodymium nitrate are each about −1000 mV (SCE). Referring to FIG. 7, samples treated in solutions containing cerium, europium, samarium, terbium and ytterbium nitrates exhibited $E_{Final}$ values of about −600 mV (SCE). Samples treated in solutions containing erbium, yttrium, lanthanum, dysprosium and holmium nitrates exhibited values for $E_{Final}$ of about −550 mV (SEC), see FIG. 8. The galvanostatic polarization plot for untreated UNS S40900, labeled "control", exhibited a value for $E_{Final}$ of about −430 mV (SCE).

These results clearly show that the cathodic reaction kinetics of these alloys are significantly inhibited upon exposure of the surfaces in all lanthanide nitrate solutions tested at elevated temperatures. Treatment in gadolinium nitrate produces the greatest degree of cathodic inhibition followed closely by treatment in neodymium and praseodymium nitrates. The results of FIGS. 6 to 8 were obtained by treatment in solutions containing 0.1M concentrations of the various lanthanide nitrates, however, corrosion inhibition was observed in solutions containing lanthanide concentrations ranging from 2% by weight up to saturation. The remaining rare earth elements including scandium, lutetium, thulium and promethium were not tested but the inventors reasonably contemplate that treatment with their corresponding halide exclusive salts would also provide similar results in view of the fact that inhibition was unexpectedly obtained with all the rare earths tested and the chemical behavior of the lanthanides are very similar.

In addition to the nitrates of the rare earth elements, compositions using rare earth chlorides were tested. The chlorides exhibited no efficacy for increasing the corrosion resistance of the steels. The ineffectual nature of the rare earth chlorides may be understood in view of the fact that the presence of chlorides in particular, and halide ions in general, are known to cause the breakdown of passive films formed on most metals including stainless steels.

Figure 9:
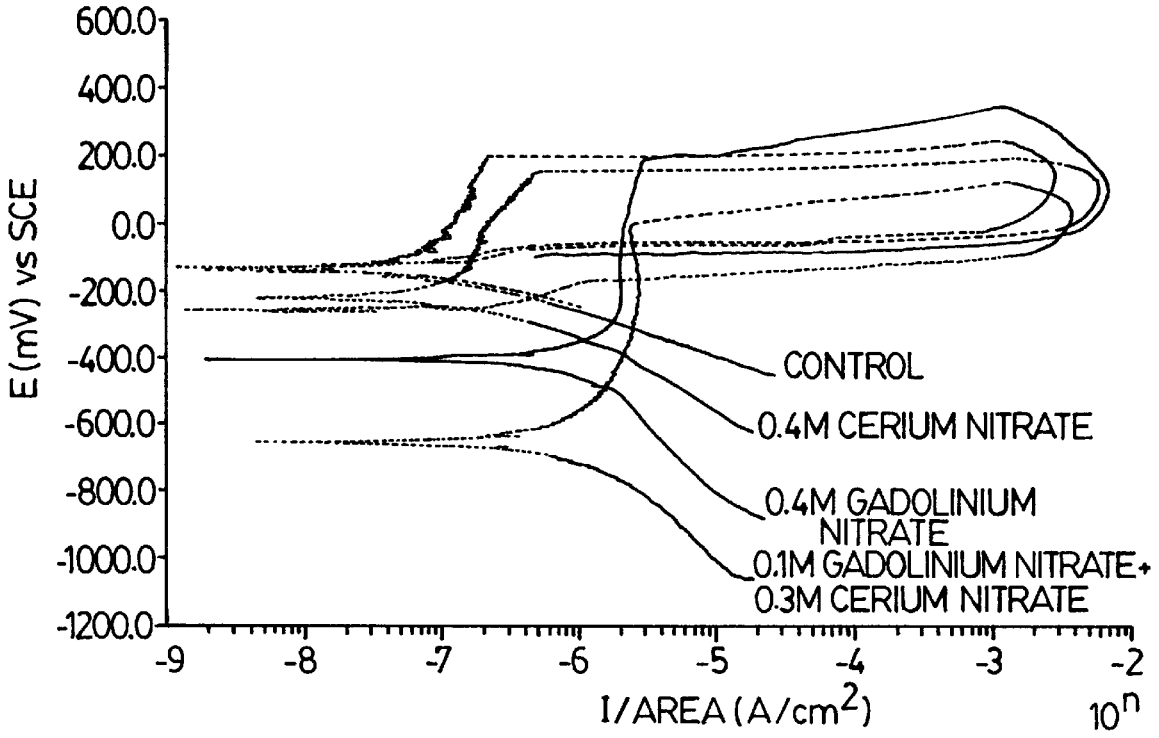
FIG. 9 shows potentiodynamic polarization plots of UNS S40900 stainless steel samples before and after treating in 0.4M cerium nitrate, gadolinium nitrate, and a mixture of 0.1 M gadolinium nitrate and 0.3 M cerium nitrate at 85° C. for 20 minutes.

B) Synergistic Effect of Combinations of Rare Earth Elements on Cathodic Inhibition According to the electrochemical data of FIGS. 6 to 8, samples treated with individual solutions of gadolinium nitrate, neodymium nitrate and praseodymium nitrate exhibit the highest degree of cathodic inhibition for the single rare earth containing compositions. The inventors have further discovered that combinations of rare earths unexpectedly produce a synergistic effect for cathodic inhibition. FIG. 9 displays four potentiodynamic polarization plots for an untreated UNS S40900 sample, a sample treated in 0.4M gadolinium nitrate, a sample treated in 0.4M cerium nitrate and a sample treated in a composition containing 0.1M gadolinium nitrate and 0.3M cerium nitrate solution, all treated samples being exposed to the compositions for 20 minutes at 85° C. The formulation containing the combination of gadolinium nitrate and cerium nitrate showed significant improvement in cathodic inhibition of UNS S40900 samples as compared to samples treated in the compositions containing the individual rare earth nitrates. It is clearly seen from the results of FIG. 9 that at the same total molarity, using a combination of cerium and gadolinium nitrate produces a cathodic inhibition on the cathodic reaction kinetics superior to the inhibition achieved with the individual nitrates.

Figure 10:
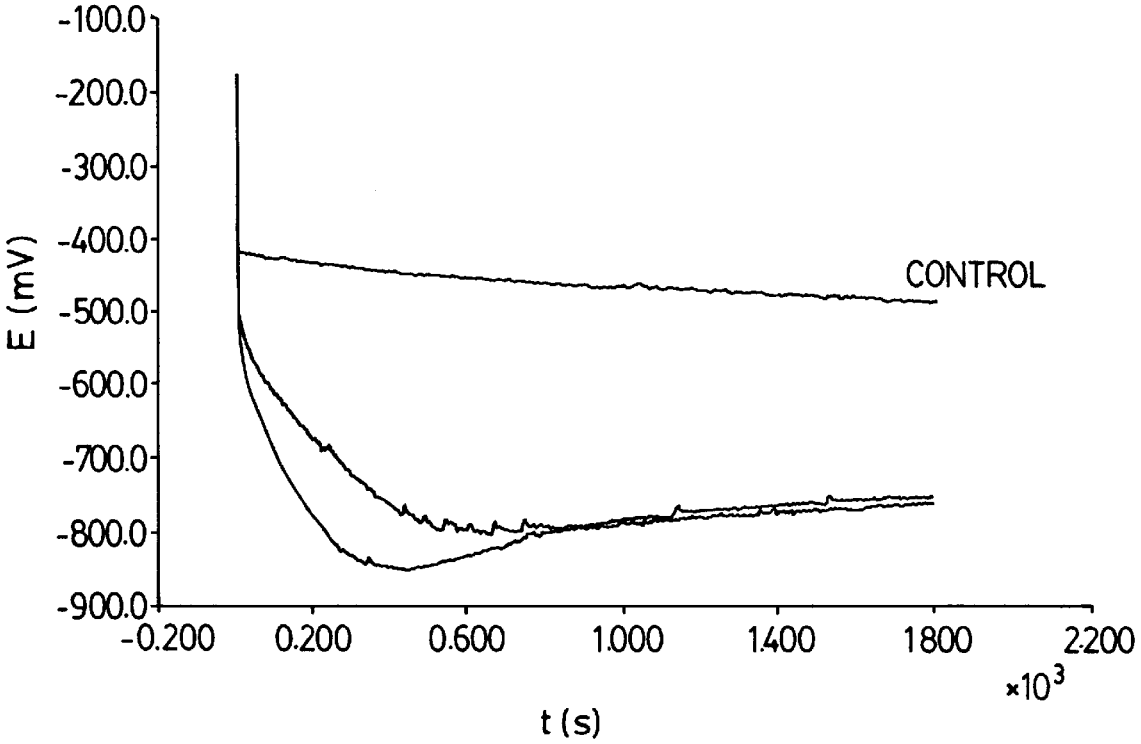
FIG. 10 shows the galvanostatic polarization curves of UNS S41045 samples taken at 5 $\mu A/cm^2$ before and after treatment in a solution comprising 0.3M cerium nitrate, 0.1 M gadolinium nitrate and 0.1 M lanthanum nitrate, pH=3.20 at 85° C. for 60 minutes.

FIG. 10 shows that UNS S41045 may be treated in an aqueous solution with a combination of Ce, Gd and La. The marginally higher Cr content compared to UNS S40900 may be beneficial for the purposes of this treatment. The difference between these alloys is the addition of Cb (Nb) and Ti as a ferritic stabilizer versus just Ti in the UNS S40900 alloy. Since Cb and Ti are surface active elements, they are expected to participate in the formation of the surface structure. It was observed that the presence of these elements did not negatively impact on the efficacy of the method to treat the alloy.

Figure 11:
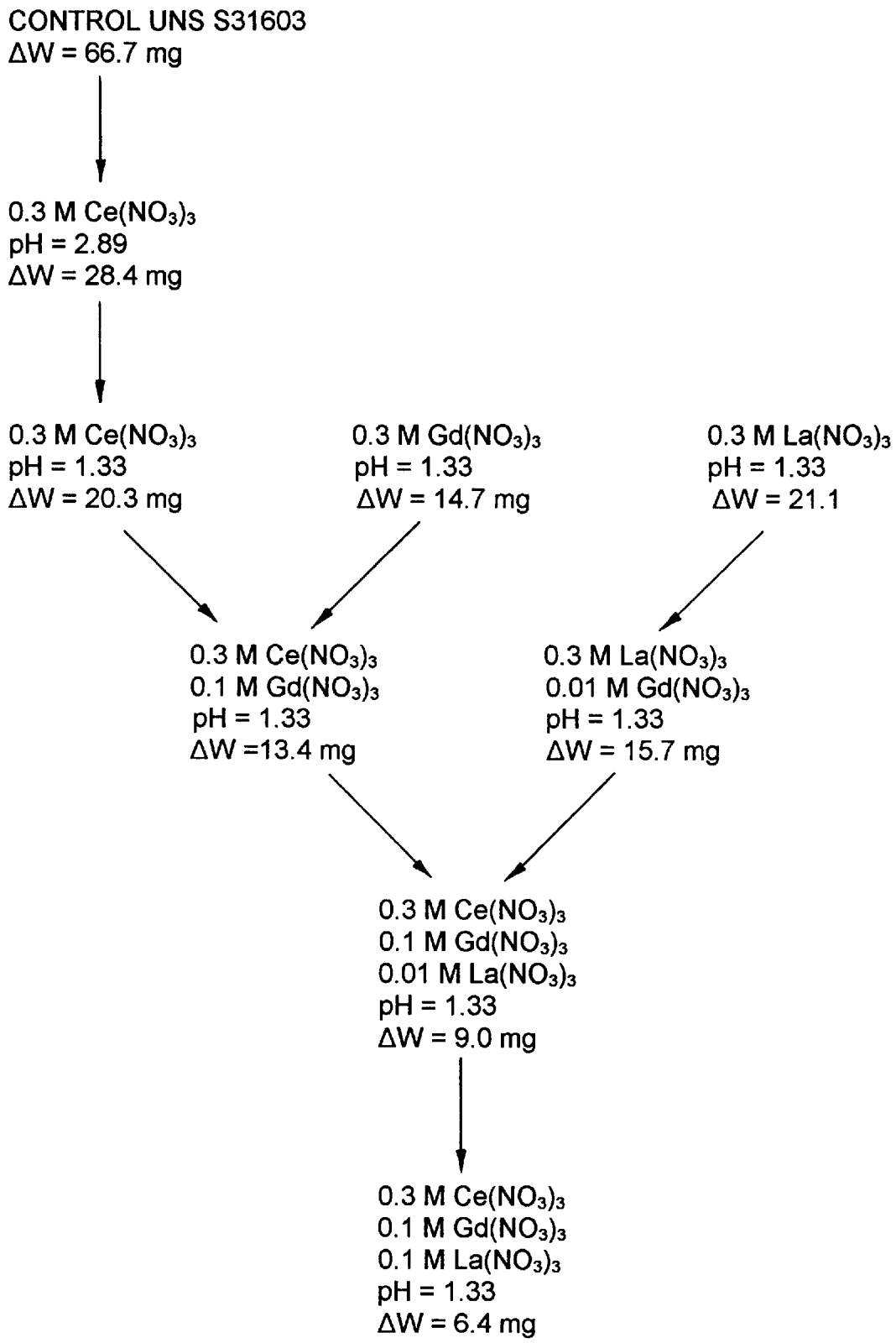
FIG. 11 is a flow chart summarizing the weight loss results of UNS S31603 alloy samples after 24 hours of ASTM G48 B testing at 22° C. after treatment in each of the indicated rare earth salt containing solutions.

FIG. 11 is a flow chart showing the effect of different binary and ternary combinations of lanthanides on weight loss resulting from crevice corrosion tests for UNS S31603 stainless steel samples. To test the synergistic effect of the combinations of lanthanides in improving the crevice corrosion resistance, UNS S31603 stainless steel samples were treated in solutions containing 0.3M cerium nitrate in combination with 0.1M concentrations of other different lanthanum nitrates. For comparison, samples treated in 0.4M cerium nitrate and control samples were tested in parallel. The pH of all solutions was adjusted to 1.32±0.01 except for the solution using cerium nitrate alone. After the treatment, the samples were tested by the ASTM G48 B standard method at 22° C. for 24 hours. The weight loss was recorded and is presented graphically in FIG. 12.

More detailed corrosion inhibition studies of binary and ternary combinations of gadolinium nitrate, praseodymium nitrate, neodymium nitrate, cerium nitrate and lanthanum nitrate on UNS S31603 samples were conducted using the different combinations/concentrations given in Table II below.

TABLE II

Figure 12:
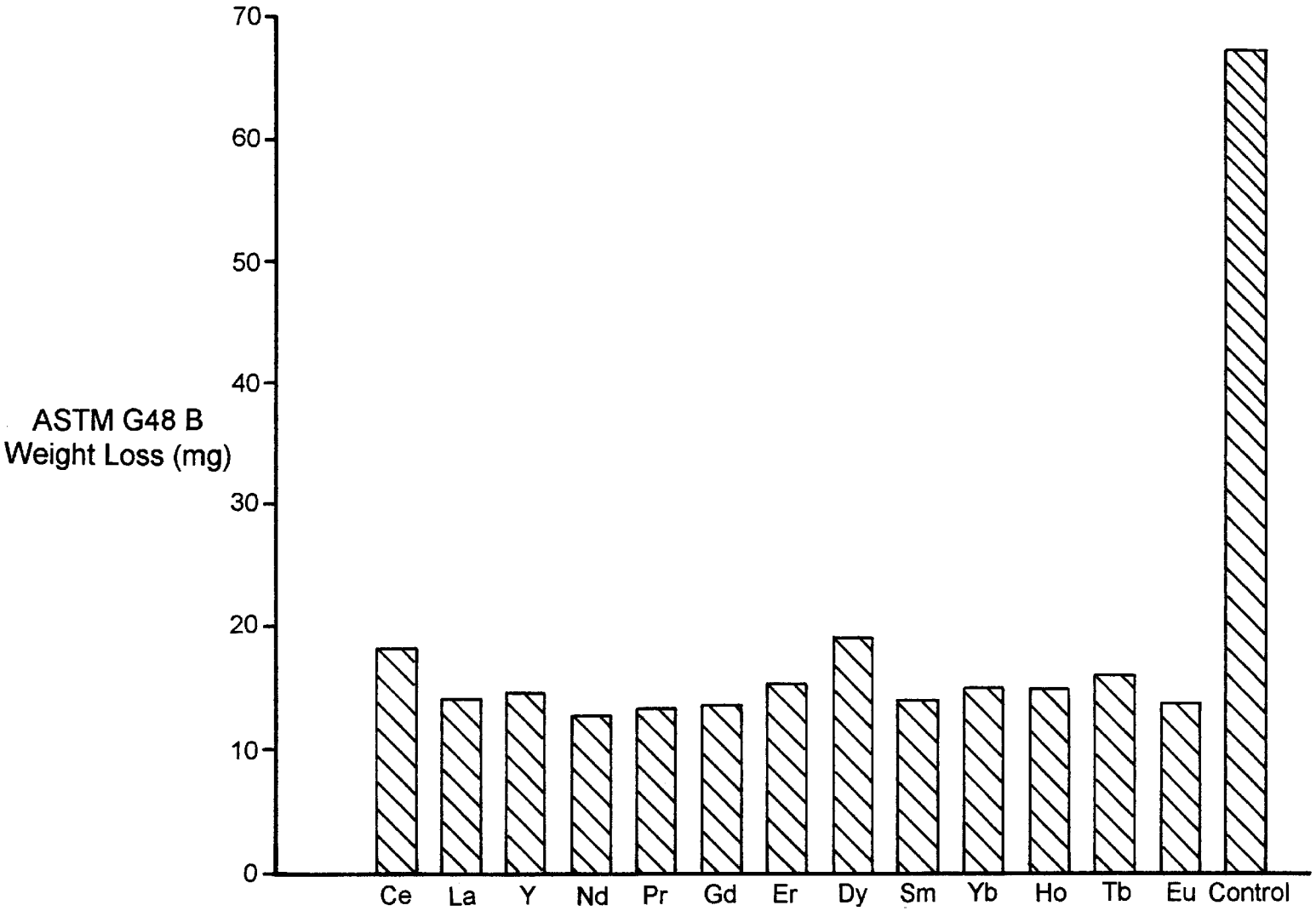
FIG. 12 illustrates the weight loss after 24 hours ASTM G48 B testing at 22° C. for UNS S31603 stainless steel samples treated in solutions of 0.3 M cerium nitrate plus an additional 0.1 M of the different indicated rare earth nitrates including cerium nitrate.

Solutions for UNS S31603 Treatment Summarized In FIG. 12

| Label | Solution |
|---|---|
| Ce3La1 | 0.3M cerium nitrate + 0.1M lanthanum nitrate |
| Ce3Gd1 | 0.3M cerium nitrate + 0.1M gadolinium nitrate |
| Ce2La1Gd1 | 0.2M cerium nitrate + 0.1M lanthanum nitrate + 0.1M gadolinium nitrate |
| Gd3Nd1 | 0.3M gadolinium nitrate + 0.1M neodymium nitrate |
| Gd3Pr1 | 0.3M gadolinium nitrate + praseodymium 0.1M nitrate |
| Gd3Pr1Nd1 | 0.3M gadolinium nitrate + praseodymium 0.1M nitrate + 0.1M neodymium nitrate |
| Control | Sample without treatment |

Note: pH of all solutions was adjusted to 1.32 ± 0.01.

Figure 13:
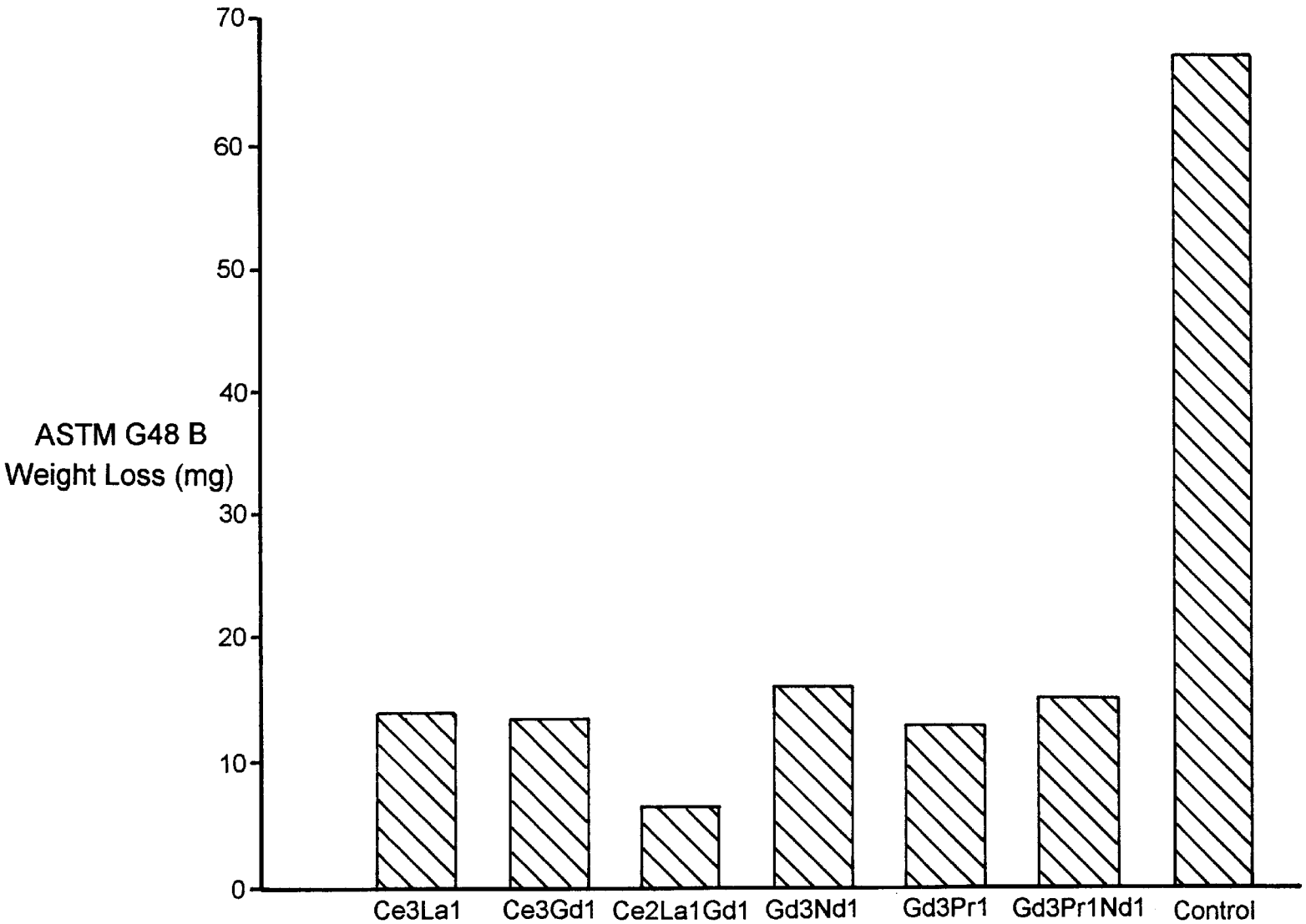
FIG. 13 illustrates the weight loss after 24 hours ASTM G48 B test at 22° C. for UNS S31603 stainless steel samples treated in solutions listed in Table II at 22° C. for 20 minutes.
Figure 14:
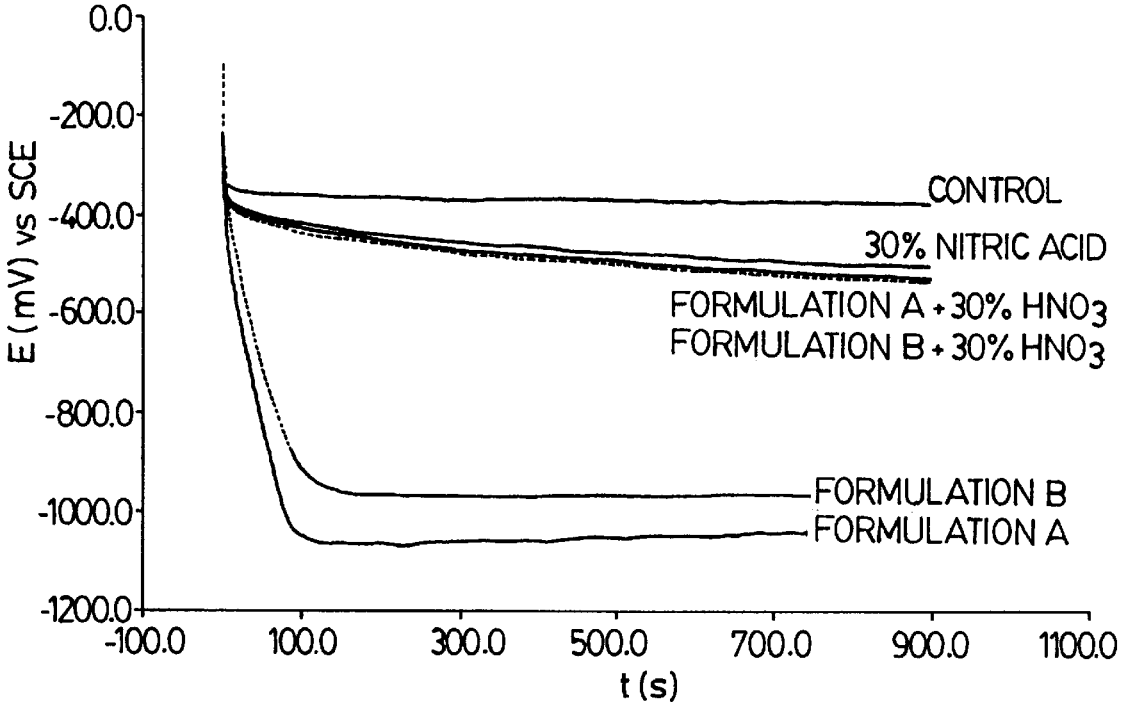
FIG. 14 shows the galvanostatic polarization plots of the UNS S40900 stainless steel samples before and after being treated in formulation A described hereinafter, formulation B described hereinafter, formulation A with 30% nitric acid, formulation B with 30% nitric acid, and 30% nitric acid alone.

The resulting weight loss values are summarized in FIG. 13. The results show that exposure of the samples for 20 minutes to compositions at 85° C. containing cerium, lanthanum and gadolinium are very effective in increasing the crevice corrosion resistance of the alloys. This was determined by the 10% ferric chloride hexahydrate crevice test (ASTM G48 B Test) at 22° C. for 24 hours.

The results show that combinations of two or more lanthanide nitrates produce a greater degree of corrosion inhibition than using a composition having only one rare earth element present. Combinations of lanthanum, cerium, gadolinium, neodymium and praseodymium nitrates all exhibit an efficacy for corrosion inhibition superior to the individual nitrates alone. It will be appreciated that in addition to the nitrates, other equivalent salts may be used so long as the halides are avoided.

As described below two example formulations, one a binary combination of lanthanide salts, and the other being a ternary combination of lanthanide salts, have been tested and shown, by laboratory accelerated corrosion tests and seawater field tests, to be very effective in improving the crevice corrosion resistance of various alloys.

Formulation A: 130.3 g/l of $Ce(NO_3)_3.6H_2O$ and 45.0 g/l of $Gd(NO_3)_3.6H_2O$ with the pH adjusted to within the range 0.5–6.5 depending on the alloys or metals being treated.

Formulation B: 130.3 g/l of $Ce(NO_3)_3.6H_2O$, 45.0 g/l of $Gd(NO_3)_3.6H_2O$ and 43.5 g/l of $La(NO_3)_3.6H_2O$ with the pH adjusted within the range 0.5 to 6.5 depending on the metal or alloy being treated.

Significant corrosion inhibition was obtained with Inconel 625 pipe samples treated using compositions based on cerium nitrate alone and formulation B. No crevice corrosion was detected on samples treated with formulation B after 30 days exposure to seawater while the untreated samples showed crevice corrosion after only six days of seawater exposure. It will be understood that the tradename Inconel refers to nickel based alloys consisting of nickel-chromium alloys and nickel-chromium-molybdenum alloys.

The major parameters of the compositions produced in accordance with the present invention are the use of one or more rare earth salt(s), pH range of the aqueous solution, temperature of the composition to which the surface of the metal is being exposed, and residence time of the metal therein. The residence time may be limited to from just a few minutes to about an hour at elevated temperatures (about 60° C. to 95° C). Lower temperatures of the compositions necessitate longer exposure times. For example, at ambient temperature, exposure times of the order of several days are required to achieve the corrosion resistance effect obtained for a few minutes exposure at elevated temperatures using the present method. Surface conditioning methods other than by exposure to acid solutions, such as mechanical or other chemical processes may also be variables to consider.

In order to achieve the satisfactory treatment effect, the pH lower value of the aqueous composition should be adjusted in an appropriate range depending on the metal or alloy being treated. In the case of the non-aluminum based alloys, the increase in the acidity of the solution to a certain level enhances the surface enrichment of beneficial alloy elements for passivity. However, if the solution pH drops beyond certain values, the effect on cathodic inhibition will be weakened. The galvanostatic polarization plots of FIG. 13 illustrates that 30% nitric acid addition can diminish the cathodic inhibition. It also causes excessive attack to the substrate and results in rapid degradation of the treatment solution when treating iron containing alloys. The inventors have found that the preferred pH for austenitic stainless steels and nickel based alloys is in the range of from about 0.5 to about 3.5 and in the range from about 2 to about 4.5 for ferritic stainless steel. The pH of the solution may be adjusted by adding nitric acid to the solution.

The upper pH value of solutions for treatment of aluminum alloys may be chosen as the upper solubility limit of said rare earth element in the aqueous solution as a function of pH which can be determined from the appropriate Pourbaix diagrams. Many of the rare earth elements have a pH determined solubility limit between 6–7. It will be understood by those skilled in the art that complexing agents may be used to extend the upper solubility limit of the rare earths so that solutions with higher pH may be used when appropriate complexing agents are present. The pH of the solutions for treatment of aluminum may also be adjusted by adding nitric acid to the solution.

The optimum treatment parameters can be adjusted according to the metals to be treated. Formulations A and B given above are non-limiting examples. While treatment in these formulations produce significant corrosion inhibition on stainless steels, it will be appreciated that many other compositions of varying rare earth salt components and concentrations produced in accordance with the present invention will provide improvement in corrosion resistance of alloys.

Detergents or surfactants may be added to the compositions for cleaning the metal surfaces. For example, a commercial surfactant such as ARMAK 1997(Akzo Chemicals Inc) may be added to the treatment solution at 0.5–1.0% for samples having surfaces contaminated with for example processing lubricating oils and finger prints which may obstruct effective chemical treatment. The choice of surfactant will be determined in part by the solubility of the surfactant in the composition for the particular pH value. The metal to be cleaned and conditioned may initially be immersed in a preconditioning bath including an acid in addition to a surfactant.

Mechanical abrasion of the surface of the metal prior to exposure to the lanthanides has been observed to increase the efficacy of the corrosion inhibition effect. This effect is possibly due to the breaking up of an existing oxide layer on the metal surface which may impede the surface reactions leading to the corrosion inhibition effect. Using abrasion in combination with the treatment solution are expected to reduce the residence time of the metal or alloy work piece in the compositions. Thus mechanical abrasion of metals and alloys being treated by the method disclosed herein is advantageous where native oxide layers are expected to be present and the lanthanide is being integrated into the surface in a method different than using the aqueous compositions of low pH.

The efficacy of the compositions disclosed herein for economically treating large quantities of metals or alloys depends on long term stability of the compositions. The present compositions were found to be very stable with no observable precipitation or degradation over a period of three years. During constant use of the compositions for treating large quantities of metal, certain materials will accumulate in the treatment bath over time. Ferric ions will build up in solution which changes the acidity of the bath. Addition of sodium hydroxide may be used to control the change in acidity. Therefore, studies were conducted to determine the effect of ferric ion concentration and sodium concentration on the efficacy of the compositions.

Due to selected dissolution of iron during exposure of iron based alloys to the compositions, ferric ions will accumulate in the solution resulting in a more aggressive solution. The effect of ferric ion on the performance of the compositions was studied by adding $Fe(NO_3)_3$ to formulation A containing 0.3 M cerium nitrate and 0.1M gadolinium nitrate. The addition of 10 ppm and 100 ppm of $Fe^{3+}$ into formulation A resulted in a reduction in the pH of the formulations from 2.53 to 2.47 and 2.13 respectively. After treating a UNS S40900 alloy steel sample at 85° C. for 20 minutes in formulation A with 10% ferric ions, the sample was observed to be slightly etched due to the hydrolysis of the cations and the pH value of the solution dropped to 1.82. When 1000 ppm ferric ions were added to formulation A, the solution became cloudy and $Fe_2O_3$ precipitated out. The solution was very aggressive and vigorously attacked the treated stainless steel samples.

Figure 15:
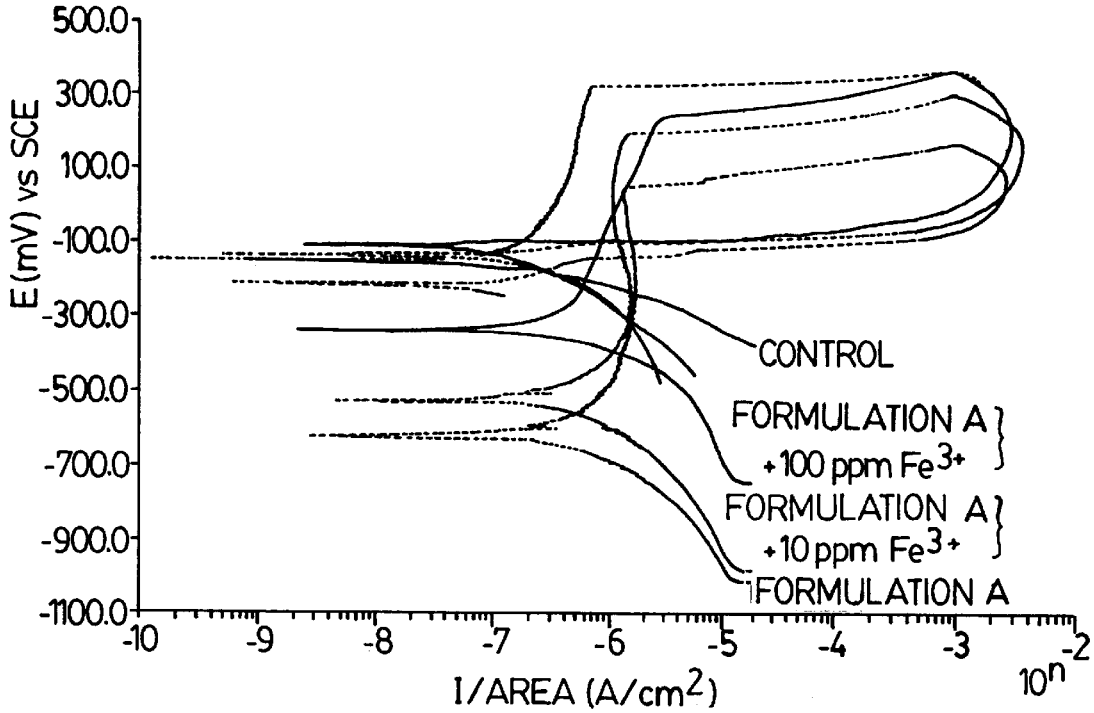
FIG. 15 shows potentiodynamic polarization plots of UNS S40900 stainless steel samples before and after treating in formulation A alone and in formulation A with 10 ppm and 100 ppm of $Fe^{+3}$ contamination.
Figure 16:
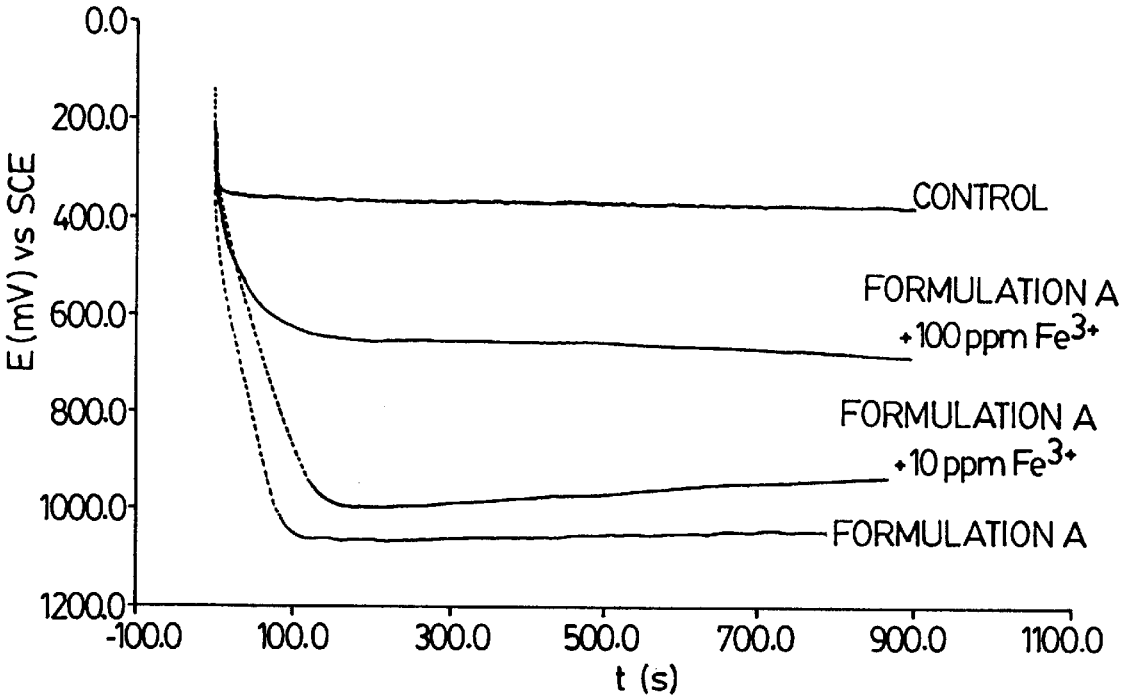
FIG. 16 shows the galvanostatic polarization plots of UNS S40900 stainless steel samples before and after treating in formulation A alone and in formulation A with 10 ppm and 100 ppm of $Fe^{+3}$ contamination.
Figure 17:
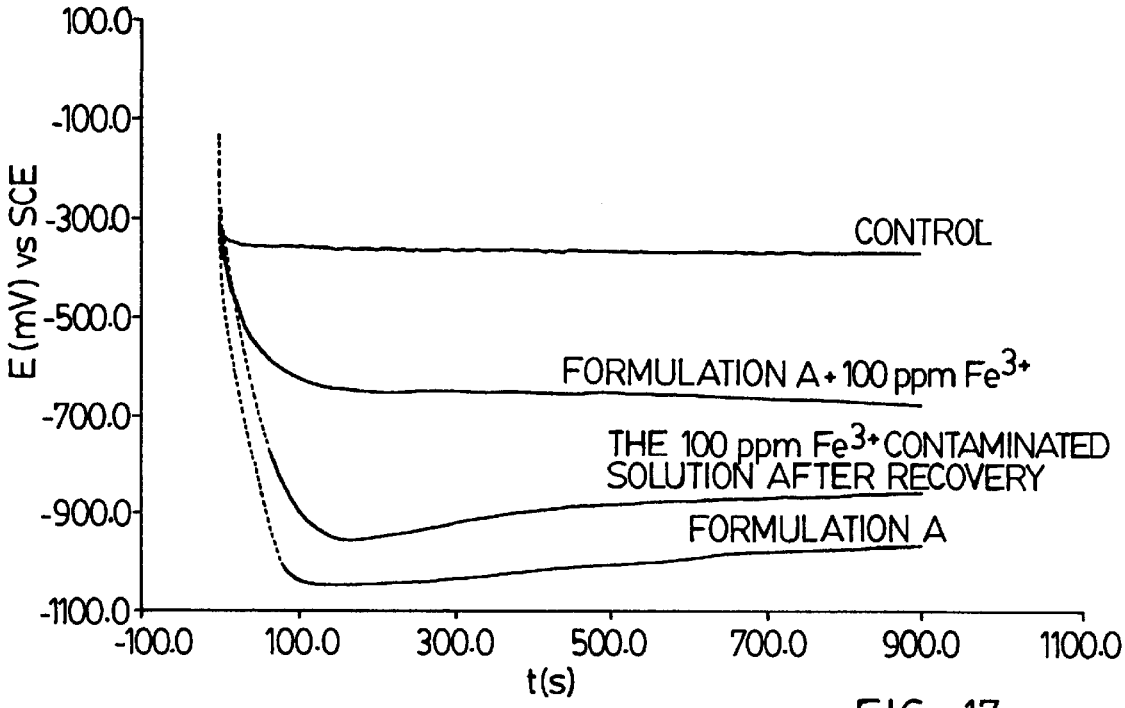
FIG. 17 displays galvanostatic polarization curves for UNS S40900 samples treated in formulation A with 100 ppm of $Fe^{+3}$ contamination before and after recovery of the solution, compared with a control sample untreated.

The adverse effect of the presence of ferric ion on the corrosion inhibition performance is readily apparent from the polarization plots in FIG. 15 and FIG. 16. As the concentration of the ferric ion increases in formulation A, the efficacy of the formulations toward cathodic inhibition decrease. The tolerance level of the ferric ion is below 100 ppm. It is important to remove the accumulated ferric ions from the solution. By adjusting the pH of the formulation to 2.5–2.8 with dilute sodium hydroxide, the ferric ion can be precipitated from the solution as ferric hydroxide and ferric oxide. The effectiveness of the formulation for corrosion inhibition may be recovered by allowing the precipitate to settle followed by filtering. The galvanostatic polarization plot of FIG. 16 was obtained on a UNS S40900 sample treated in formulation A originally contaminated by 100 ppm $Fe^{3+}$. The formulation was subsequently recovered as discussed above and from FIG. 17 it is clear the recovered formulations exhibit effective cathodic inhibition.

Sodium nitrate will also accumulate in the treatment compositions as a result of bath maintenance. The effect of sodium content in the treatment formulations was studied by adding sodium nitrate to formulation A at three levels, 0.1M, 0.5M, and 1M. Potentiodynamic polarization plots on UNS S40900 samples in formulation A with the above levels of sodium nitrate showed the presence of sodium had no discernable adverse affects on the corrosion inhibition behavior (data not shown).

Figure 18:
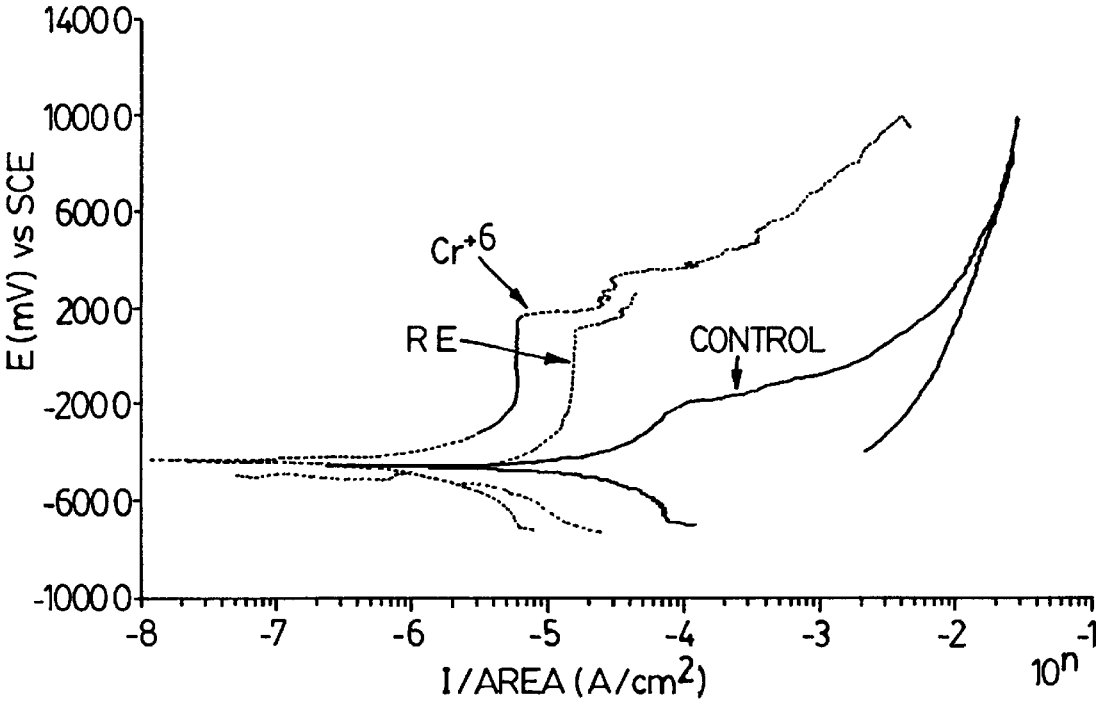
FIG. 18 shows the potentiodynamic polarization plots for an Al—Si clad brazing sheet sample, brazed in an inert atmosphere, then treated using a rare earth salt solution according to the present invention and the same alloy treated using a commercial chromate treatment.

FIG. 18 is a potentiostatic polarization plot for a brazing aluminum alloy before and after treatment in a solution comprising formulation A diluted by a factor of 7 using water. The alloy was a two-sided clad brazing sheet comprising a core material consistent with AA3005 aluminum alloy and a lower melting Al—Si clad layer on both sides of the core.

The composition of the double clad aluminum material was:

| Element | Core | Clad |
|---|---|---|
| Silicon | 0.40 max. | 9.0–11.0 |
| Iron | 0.50 max. | 0.50 max. |
| Copper | 0.20–.040 | 0.10 max. |
| Manganese | 1.0–1.25 | 0.10 max. |
| Magnesium | 0.35–.55 | 0.10–0.30 |
| Titanium | 0.15 max. | — |
| Zinc | 0.15 max. | 0.10 max. |
| Other | 0.05 ea. | 0.05 ea. |
| Other Tot. | 0.15 max. | 0.15 max. |
| Aluminum | remainder | remainder |

The brazing sheet samples were subjected to a typical brazing cycle (heating to 1100° F. for 1–3 minutes in dry nitrogen atmosphere) prior to testing so that the samples were tested in the as brazed condition. The samples were rinsed in acetone and then immersed in diluted formulation A as previously described. The formulation was "aged" by immersing an aluminum sample therein for 8 hours at 85° C. after the samples were immersed in the formulation for 1 hour at 85° C. For comparison, aluminum alloy samples were subjected to a chromate treatment (curve labeled $Cr^{+6}$) in a 4% by volume chromate solution at 35 to 40° C. for 2.7 minutes. The samples were tested for corrosion resistance in a 5% solution of auto coolant, "ZEREX", BASF 340-2 which also contained 150 ppm salts as follows: 0.2077 g/liter $NaHCO_3$, 0.2231 g/liter $Na_2SO_4$ and 0.2487 g/liter NaCl heated to 75° C. stirred with a glass impeller. The corrosion studies comprised free corrosion potential monitoring and cyclic polarization scans.

From the cyclic polarization scans the pitting potential and corrosion resistance, $R_p$, were determined as follows:

| Treatment | Control | $Cr^{+6}$ | Rare Earth |
|---|---|---|---|
| Corr. Rate, $R_p$ | 3.945 | 0.207 | 0.713 |
| Pitting $E_p$, V(SCE) | −0.200 | 0.180 | 0.130 |

From the cyclic scans of FIG. 18 and the calculated corrosion resistance it can be seen that the rare earth treatment significantly increases the corrosion resistance of the brazed aluminum alloys.

A series of other compositions were tested which were found to increase the corrosion resistance of the aluminum alloy. The preferred pH range for solutions used to treat aluminum alloys is between 4.5 and 6.5. At pH values below 4.5 the dissolution of aluminum is excessive. Compositions for treating aluminum may also include a source of aluminum previously introduced into the aqueous solution in order to reduce the corrosive attack on the alloy by the composition. The aluminum can be added in the form of aluminum salts that can be added directly to the compositions, for example aluminum nitrate was added directly and was found to be effective in the range of about 5 to 10 grams of the nitrate per liter of the composition. Alternatively, the aluminum may be generated in the solution by aging, that is, by placing a piece of aluminum into the freshly prepared composition for a preselected period of time to get the preferred amount of aluminum. The process of abrading the aluminum in the treatment solution will produce a fine aluminum powder which is another way of "Al aging" the solution.

Figure 19:
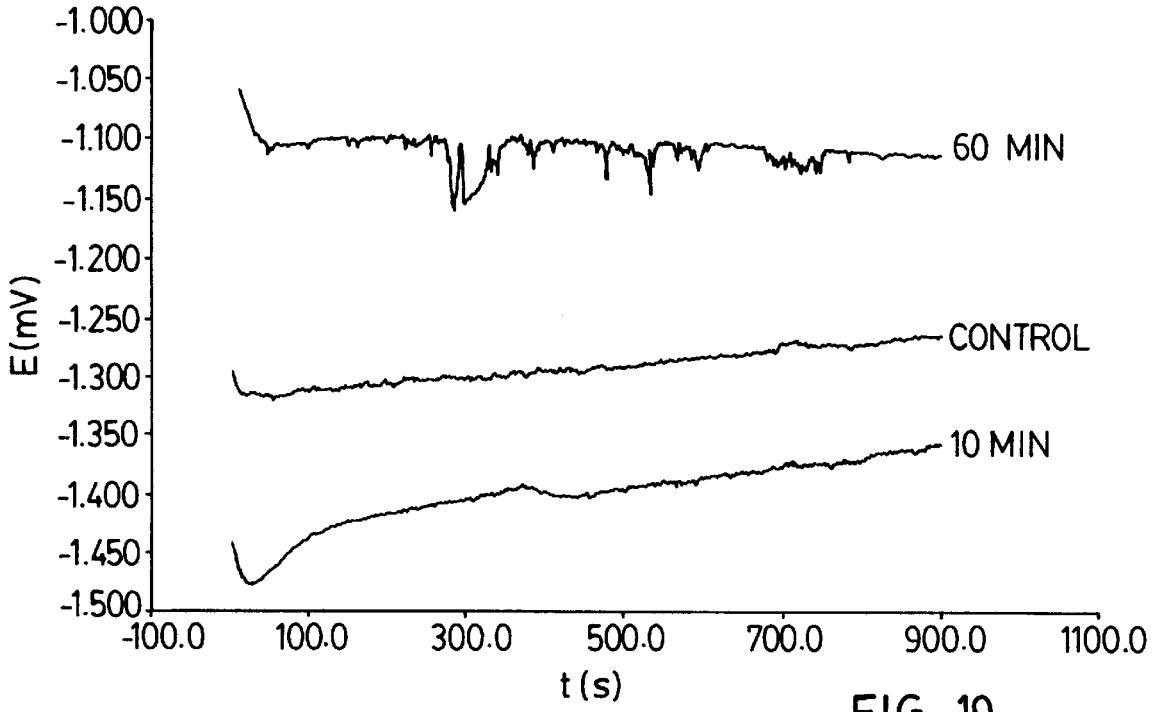
FIG. 19 shows the galvanostatic polarization curves for UNS A93003 at 10 $\mu A/cm^2$ in an Al aged aqueous solution of 0.1 M $Ce(NO_3)_3$, pH=5.42 at a temperature of 85° C., for 10 minutes exposure, 60 minutes exposure, and an untreated control sample.

FIG. 19 compares the galvanostatic polarization behavior for three samples of commercial aluminum alloy UNS A933003 treated in an aqueous solution of Al aged 0.1M $Ce(NO_3)_3$, pH=5.42 at a temperature of 85° C., for 10 minutes exposure, 60 minutes exposure, and an untreated control sample. It was observed that the alloy treated for 10 minutes exhibited a lower galvanostatic potential over that of the control samples. However, it was observed that increased exposure or treatment times of the order of 60 minutes was detrimental in that it reduced the effect of corrosion inhibition. This illustrates the distinct difference between corrosion inhibition achieved by modifying the surface in the present invention to inhibit cathodic processes and others which rely upon forming a protective barrier layer such as conversion a coating or anodized coatings.

Figure 20:
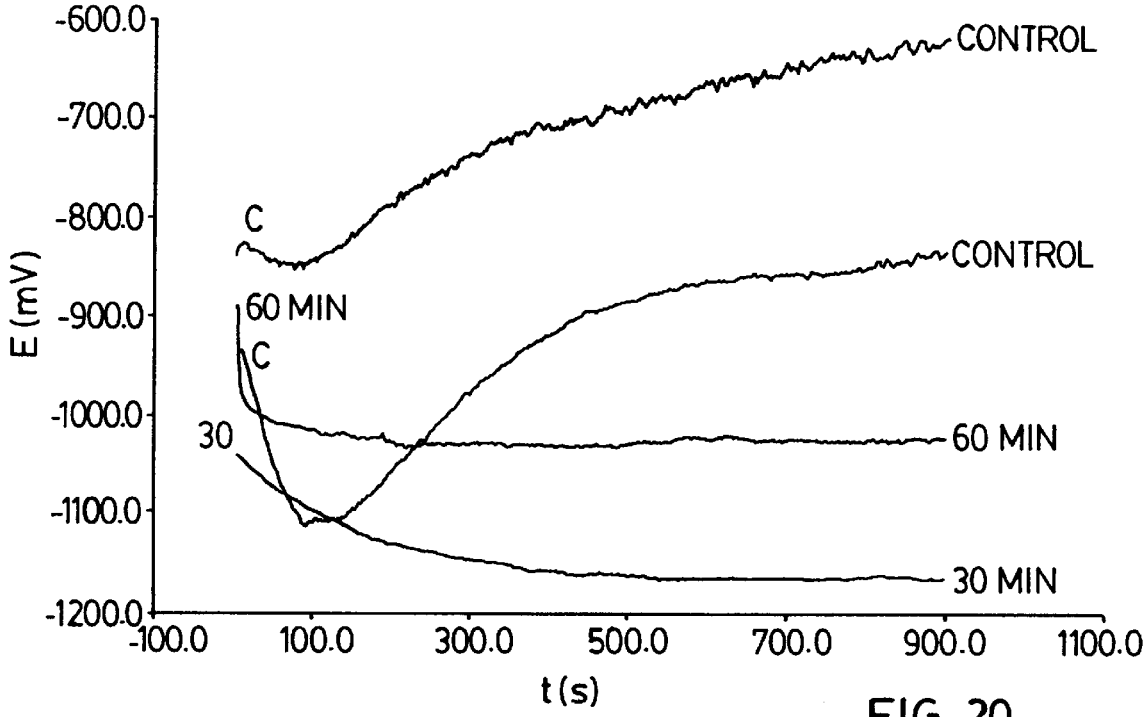
FIG. 20 compares the galvanostatic polarization behavior at 10 $\mu A/cm^2$ for an Al—Si clad brazing sheet sample, brazed in an inert atmosphere, then abraded and treated in an aqueous solution of 0.1 M $Ce(NO_3)_3$, pH=5.45 at a temperature of 85° C., for 30 minutes exposure, 60 minutes exposure, and unabraded, untreated control samples.

The galvanostatic polarization curves of FIG. 20 show that the heterogeneous structure of the Al—Si clad brazing sheet sample, brazed in an inert atmosphere, can be effectively treated using the present method of exposure to rare earth solutions. As with the UNS A93003 alloy, shorter treatment times gave the greatest benefit to reduction of the cathodic reaction kinetics over that of the control sample.

Figure 21:
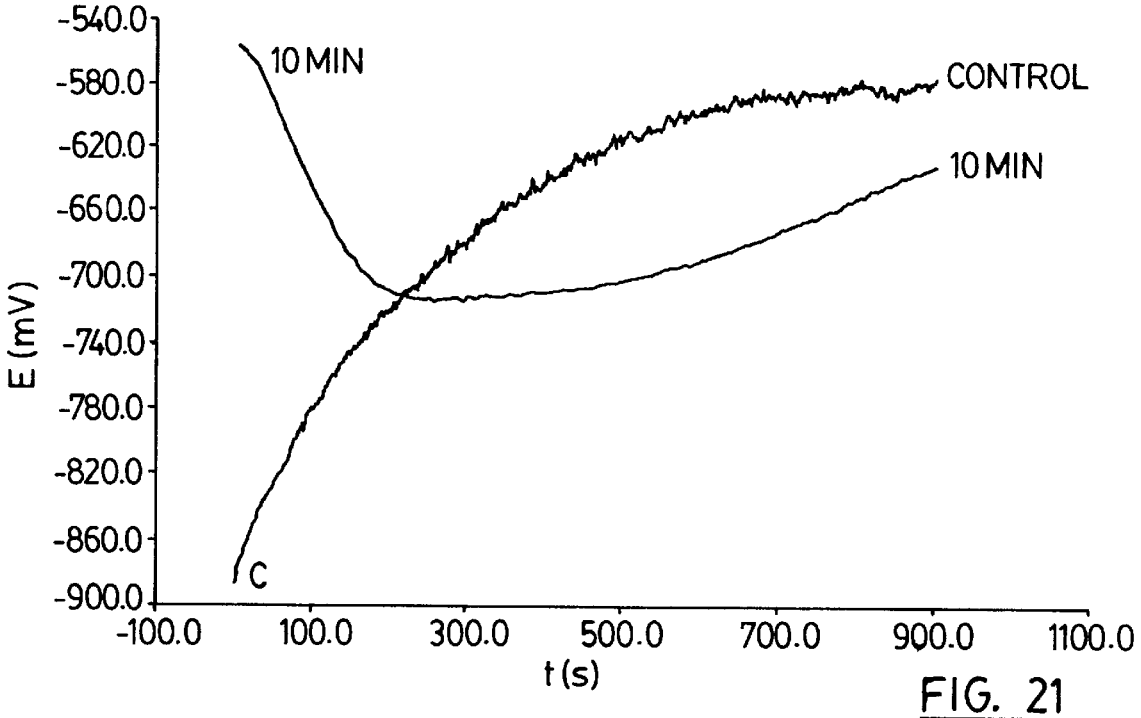
FIG. 21 compares the galvanostatic polarization behavior at 10 $\mu A/cm^2$ for an Al—Si clad brazing sheet sample, brazed in an inert atmosphere, before and after treatment in a solution of 0.1M $Ce(NO_3)_3$, pH=5.45 at a temperature of 85° C., for 10 minutes exposure and an untreated control sample.
Figure 22:
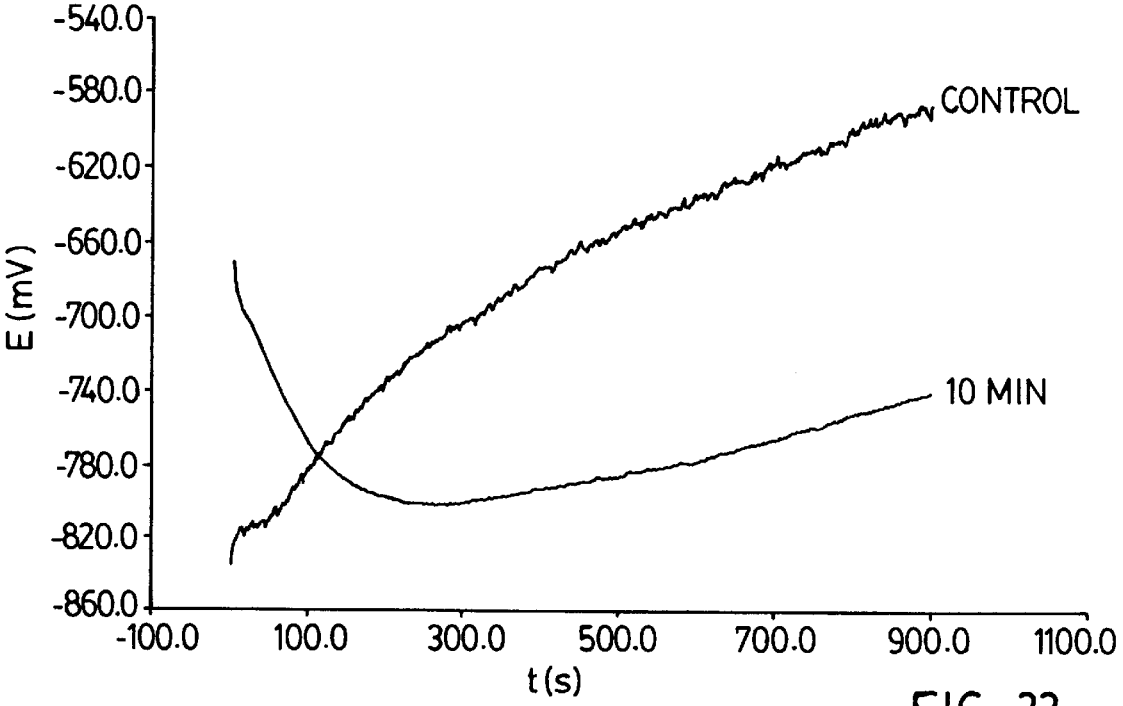
FIG. 22 compares the galvanostatic polarization behavior at 10 $\mu A/cm^2$ of an Al—Si clad brazing sheet sample, brazed in an inert atmosphere, then treated in an Al aged aqueous solution of 0.1 M $Ce(NO_3)_3$, pH=5.50 at 85° C., for 10 minutes exposure and an untreated control sample.

The galvanostatic polarization results for the unabraded samples, see FIGS. 21 and 22, indicate these samples were more difficult to treat than the abraded samples of FIG. 20 as shown in the higher galvanostatic stabilization potentials. Further, the treatment in Al aged rare earth solutions resulted in lower potentials in the galvanostatic scan, FIG. 22 versus FIG. 21, suggesting the aluminum aged solution enhances treatment. It is also to be noted that significant corrosion inhibition can be obtained with very short treatments of around 10 minutes.

The corrosion inhibition on aluminum and its various alloys advantageously achieved in a matter of minutes using the method disclosed herein is a result of modification of the thin compact oxide film inherent to aluminum, rather than purposefully growing a thick uniform protective oxide coating by known conversion coating processes or anodizing. Prior art methods such as disclosed in Mansfeld (U.S. Pat. No. 5,194,138) require much longer treatment times due to the fact thick protective coatings are being formed, necessitating multiple treatment steps.

Figure 23:
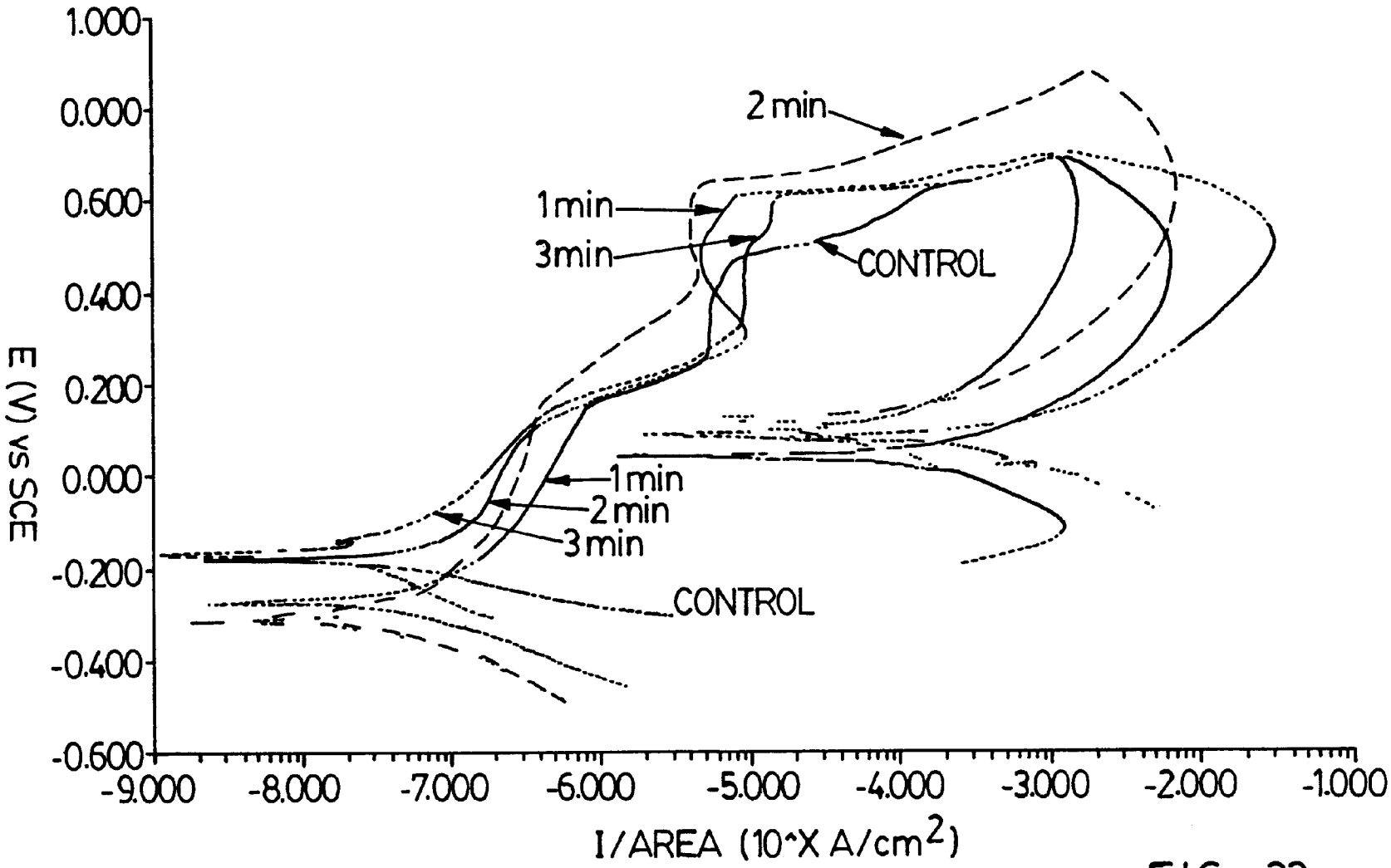
FIG. 23 shows potentiodynamic polarization plots of copper alloy samples treated with rare earth salt solutions discussed hereinafter.

FIG. 23 is a potentiostatic polarization plot of a C12200 phosphorous deoxidized copper sample before and after treatment in a composition containing 130.3 g/l of cerium nitrate, and 45.0 g/l gadolinium nitrate and 10 g/l $Al(NO_3)_3.9H_2O$. The pH was adjusted to 1 with $HNO_3$ and the solution heated to 35° C. The copper samples were first cleaned in 10% $H_2SO_4$ and then rinsed in acetone prior to treatment in the rare earth salt solutions. The samples were tested for corrosion resistance in a 5% solution of auto coolant, "ZEREX", BASF 340-2 which also contained 150 ppm salts as follows: 0.2077 g/liter $NaHCO_3$, 0.2231 g/liter $Na_2SO_4$ and 0.2487 g/liter NaCl heated to 75° C. stirred with a glass impeller. The corrosion studies comprised free corrosion potential monitoring and cyclic polarization scans. Several samples were tested in the same composition but for different periods of time with the cyclic potentiodynamic scans for a control sample not exposed to the formulation and samples exposed for 1, 2 and 3 minutes.

From the cyclic polarization scans of FIG. 23 the pitting potential and corrosion resistance, $R_p$, were determined as follows:

| Time min. | 0 Control | 1 | 2 | 3 |
|---|---|---|---|---|
| Corr. Rate $R_p$ mpy | 21.99E-3 | 16.69E-3 | 11.75E-3 | 7.72E-3 |
| Pitt. $E_p$ V(SCE) | 0.490 | 0.625 | 0.660 | 0.620 |

Although the corrosion rate of the copper samples was low in the test solution, the rare earth salt treatment successfully reduced the corrosion rate to a third of the untreated value. The pH of the compositions is preferably adjusted in the range of 1 to 6.5. The data of FIG. 23 shows that the method of the present invention may be advantageously used to increase the corrosion resistance of copper and its alloys.

Seawater Crevice Corrosion Studies

The effect of the treatment on the crevice corrosion resistance of different kinds of stainless steels was evaluated by field seawater tests. The chemical composition of the stainless steels tested is given in Table III below. Samples were cut into 25×50 mm for sea water crevice tests. Prepared samples were wet ground with 600 grid emery paper and then ultrasonically cleaned with acetone, dried with clean air before further treatment or testing.

TABLE III

Composition of Relevant Stainless Steels Used in This Study (wt %)

| | Elements | | | | | | | | | |
|---|---|---|---|---|---|---|---|---|---|---|
| Alloys | Cr | Ni | Mo | Cu | Mn | C | P | S | Si | N |
| UNS S30403 | 19.0 | 9.7 | — | — | 2.0 | 0.03 | 0.045 | 0.03 | 1.0 | — |
| UNS S31603 | 17.2 | 10.1 | 2.10 | — | 1.45 | 0.021 | 0.032 | 0.011 | 0.59 | .06 |
| UNS N08904 | 20.1 | 24.7 | 4.38 | 1.42 | 1.65 | 0.013 | 0.029 | 0.004 | 0.35 | 0.07 |
| UNS N08925 | 20.60 | 24.70 | 6.10 | 0.88 | 0.86 | 0.006 | 0.018 | 0.002 | 0.37 | 0.198 |
| UNS S31254 | 19.8 | 17.9 | 6.06 | 0.65 | 0.45 | 0.019 | 0.022 | 0.001 | 0.33 | 0.20 |
| UNS N08367 | 20.42 | 23.76 | 6.23 | — | 0.34 | 0.029 | 0.021 | 0.001 | 0.37 | 0.23 |
| AVESTA 654SMO | 24.6 | 21.9 | 7.3 | 0.4 | — | 0.015 | — | — | — | 0.487 |
| VDM* 2803Mo | 29.00 | 3.95 | 2.41 | — | 0.29 | 0.006 | 0.017 | 0.002 | 0.24 | 0.020 |

*VDM Cronifer 2803Mo also comprises 0.43% Nb, 0.03% Co and 0.002% B.

The composition used for the treatment of the samples comprised 0.05M cerium nitrate and the samples were treated at 90 to 95° C. for 1 hour at a pH between 2.5 to 2.9. Samples for seawater field tests were mounted in treated and untreated pairs for visual comparison. A "TEFLON" crevice washer provided twelve crevice sites on each side of the sample. The sea water tests were performed both in brackish water in a channel and in chlorinated brackish water in an outlet trough of a testing rig. Parallel tests for treated and untreated tubes were also conducted in a simulated heat exchanger rig.

Table IV below summarizes the effect of cerium treatment in improving the crevice corrosion resistance of stainless steels in brackish water and chlorinated seawater.

TABLE IV

| Sample Condition | UNS S30403 | UNS S31603 #1 | UNS S31603 #2 | UNS N08904 #1 | UNS N08904 #2 | UNS N08925 #1–#3 | UNS S31254 #1 & #2 | AVESTA 654SMO #1 & #2 |
|---|---|---|---|---|---|---|---|---|
| | Crevice Corrosion Sites Observed On Samples After Field Test In (2 ppm) Chlorinated Brackish Water For 24 Days | | | | | | | |
| Untreated | 5 | 7 | 5 | 5 | 5 | 0 | 0 | 0 |
| Cerium Treated | 0 | 0 | 0 | 0 | 0 | 0 | 0 | 0 |

TABLE V

| Sample Condition | VDM 2803Mo | UNS S31603 | UNS N08367 | UNS N08925 |
|---|---|---|---|---|
| | Crevice Corrosion Sites Observed On Samples After Field Test In Chlorinated Seawater For 60 Days In 2 ppm Chlorinated Brackish Water | | | |
| Untreated | 0 | 18 | 1 | 4 |
| Cerium Treated | 0 | 12 | 0 | 0 |

Table VI below summarizes the results of steel samples after 100 days of testing in brackish seawater. The effect of the treatment in improving the crevice corrosion resistance in the harsh seawater environment is quite significant.

TABLE VI

| Sample Condition | UNS S30403 #1 | UNS S30403 #2 | UNS S31603 | UNS N08904 | UNS N089250 | UNS S31254 | AVESTA 654SMO |
|---|---|---|---|---|---|---|---|
| | Crevice Corrosion Sites Observed On Samples After Field Test In Brackish Water For 100 Days | | | | | | |
| Untreated | 20 | 19 | 3 | 2 | 1 | 0 | 0 |
| Cerium Treated | 0 | 4 | 0 | 0 | 0 | 0 | 0 |

Table IV shows that the treatment of UNS S30403, S31603 and N08904 significantly reduced or eliminated crevice corrosion in brackish water chlorinated with 2 ppm free chlorine for 24 days. Most of the untreated control samples of the same material exhibited significant crevice corrosion. Samples of untreated 6 Mo super stainless steels exhibited significant crevice corrosion after immersion in 2 ppm chlorinated brackish water for 60 days.

Table V below illustrates that cerium treatment resulted in crevice corrosion resistance of stainless steels immersed in chlorinated seawater.

The studies of corrosion inhibition on various metals and alloys disclosed herein have shown that the cathodic reduction reactions occurring on stainless steel surfaces in a seawater environment are controlled by the mass transport of oxygen and/or protons in the solution. Chemical treatment with cerium nitrate effectively inhibits the cathodic kinetics of the oxygen reduction by impeding the charge transfer at the electrode, reducing the rate by more than one order of magnitude. The same treatment alters the reduction of protons on stainless steels from a mass transport controlled reaction to a reaction under mixed control resulting in the cathodic reduction of protons being restrained and the reaction occurring at higher overvoltage than for untreated steel.

Aqueous compositions using gadolinium nitrate alone give the most improvement in corrosion resistance compared to compositions using the other rare earth nitrates alone but comparable results are achieved with cerium and praseodymium. There is a significant synergism among lanthanides in inhibiting the electrode kinetics, especially cathodic kinetics. The pH of the compositions for each the ferritic and austenitic stainless steels is preferably adjusted to assist in the surface enrichment of beneficial alloy elements such as chromium and molybdenum. At pH values too low the metal or alloy will undergo dissolution at rates too high to have a beneficial effect on cathodic inhibition.

Seawater field tests provided solid evidence for the effect of the lanthanide chemical treatment in improving the crevice corrosion resistance of variety of austenitic stainless steels including 6 Mo super stainless steels and inconel alloy. Lanthanide chemical treatment increases the localized corrosion resistance of ferritic stainless steel UNS S40900 in salt contaminated auto coolant.

Surface analysis confirmed that both the enrichment in the chromium content of the surface film and the cathodic inhibition resulting from the blocking effect of the active sites by lanthanide complexes or oxyhydroxide are responsible for the increased resistance of austenitic stainless steels to crevice corrosion.

In the surface treatment method using the aqueous compositions disclosed herein, the surface of the metal or alloy is activated by the pH of the composition. In addition to chemical activation of the surface by using compositions with low pH, mechanical abrasion may be used as an alternative or in combination with chemical activation. Using mechanical abrasion initially to condition the surface followed by immersion in the composition would facilitate use of higher pH values since a primary effect of the pH is to condition the surface. Mechanical abrasion in combination with the solution treatment may reduce, or synergistically reduce the treatment time. For deposition of the rare earths using processes other than aqueous compositions, surface activation may be achieved using mechanical abrasion, sputter etching, particle bombardment and the like.

The metal or alloy being treated could be subject to a pretreatment by immersion in an acid bath absent the rare earth salts in order to condition the surface after which the work piece would be immersed into the particular composition containing the rare earth salt(s).

The preferred method disclosed herein of increasing the corrosion resistance of metals comprises exposing the surface of the metal to an aqueous composition containing one or a combination of lanthanides. The use of a liquid solution allows full access to the surface area of any shape of work piece. However, it will be understood that other methods of treating the surface of a metal may be used, including sputtering, plasma spraying and the like, wherein rare earths are deposited on the alloy surface. Those skilled in the art would be able to determine the operative processing conditions for each deposition procedure.

The method disclosed herein is useful for treating products fabricated from commercial alloys which are used in environments prone to aqueous corrosion. The treatment may be carried out after production of the metal or alloy itself or after the product has been produced from the alloy. After a product has been produced from the alloy, it can be treated in a composition specifically optimized for the particular material and corrosive environment in which the product will be used.

While the compositions and method of treating metals and alloys for increasing corrosion resistance has been described and illustrated with respect to certain combinations of lanthanides, it will be readily apparent to those skilled in the art that numerous variations of these combinations may be made without departing from the scope of the invention described herein.

Therefore what is claimed is:

1. A method of treating a surface of aluminum and alloys thereof to increase corrosion resistance by modification of the surface to inhibit cathodic processes, comprising:

providing an aqueous solution comprising dissolved aluminum and a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 4.5 to an upper solubility limit of said salt of at least one rare earth element in said aqueous solution as a function of pH; and exposing a surface of said aluminum or alloy thereof to the aqueous solution, in a single step treatment, for an effective period of time and with the solution being at an effective temperature to modify said surface to inhibit cathodic processes but not to purposefully grow a thick protective oxide coating thereon.

2. The method according to claim 1 wherein said at least one rare earth is present in an amount of from about 2% by weight to saturation in said aqueous solution.

3. The method according to claim 2 wherein said salt is a nitrate and said at least one rare earth is selected from the group consisting of cerium, gadolinium, neodymium, praseodymium, lanthanum and any combination thereof.

4. The method according to claim 3 wherein the pH is adjusted to a value from at least about 5.5, the effective temperature of the aqueous solution being in the range from about 75° C. to about 95° C., and wherein the surface is exposed to said aqueous solution for a period of time less than about one hour.

5. The method according to claim 3 wherein said at least one rare earth is cerium.

6. The method according to claim 3 wherein said aluminum originates from aluminum metal dissolved in said aqueous solution.

7. The method according to claim 3 wherein said aluminum originates from an aluminum compound dissolved in said aqueous solution.

8. A method of treating a surface of stainless steels, nickel alloys, copper and copper alloys to increase corrosion resistance by modification of the surface to inhibit cathodic processes, comprising:

providing an aqueous solution comprising a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 0.5 to an upper solubility limit of said salt of at least one rare earth element in said aqueous solution as a function of pH; and exposing said surface to the aqueous solution in a single step exposure for an effective period of time with the solution being at an effective temperature to modify said surface to inhibit cathodic processes.

9. The method according to claim 8 wherein said at least one rare earth is present in an amount of from about 2% by weight to saturation.

10. The method according to claim 9 wherein said salt is a nitrate and said at least one rare earth is selected from the group consisting of cerium, gadolinium, neodymium, praseodymium, lanthanum and any combination thereof.

11. The method according to claim 10 wherein said at least one rare earth is cerium.

12. The method according to claim 10 wherein said at least one rare earth is gadolinium.

13. The method according to claim 10 wherein the metal or alloy is a ferritic stainless steel and the pH is adjusted to from about 2 to about 4.5, and the effective temperature of the aqueous solution is from about 60° C. to about 95° C.

14. The method according to claim 13 wherein said temperature is at least 75° C. and the period of time is up to about one hour.

15. The method according to claim 13 wherein said pH is adjusted using $HNO_3$ acid.

16. The method according to claim 10 wherein the metal or alloy is an austenitic stainless steel or a nickel based alloy, and the pH is adjusted to from about 0.5 to about 3.5, and the effective temperature of the aqueous solution is from about 60° C. to about 95° C.

17. The method according to claim 16 wherein said temperature is at least 75° C. and the period of time is up to about one hour.

18. The method according to claim 16 wherein said pH is adjusted using $HNO_3$ acid.

19. The method according to claim 10 wherein the metal or alloy is copper or a copper alloy, and wherein the pH is adjusted to a value from about 0.5 to about 6.5, and the effective temperature of the aqueous solution is from about 60° C. to about 95° C.

20. The method according to claim 19 wherein said temperature is at least 75° C. and the period of time is up to about one hour.

21. The method according claim 10 wherein said nickel based alloy is selected from the group consisting of nickel-chromium alloys and nickel-chromium-molybdenum alloys.

22. The method according to claim 8 wherein the aqueous solution comprises a surfactant.

23. The method according to claim 8 including abrading the metal or alloy surface prior to or during exposure to the aqueous solution.

24. A method of treating stainless steels, nickel based alloys, copper and copper alloys to increase corrosion resistance by modification of the surface to inhibit cathodic processes, comprising:

providing an aqueous solution comprising a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, and a pH-modifying agent present in an amount effective to adjust the pH to from about 0.5 to an upper solubility limit of said salt of at least one rare earth element in said aqueous solution as a function of pH;

conditioning a surface of the metal or alloy by mechanically abrading the surface; and exposing said surface to the aqueous solution in a single step treatment for an effective period of time and with the solution being at an effective temperature to modify said surface to inhibit cathodic processes.

25. The method according to claim 24 wherein the step of mechanically abrading the surface is done either prior to or during exposure of the surface to the aqueous solution.

26. The method according to claim 25 wherein said at least one rare earth is present in an amount of from about 2% by weight to saturation in said aqueous solution.

27. The method according to claim 26 wherein said salt is a nitrate and said at least one rare earth is selected from the group consisting of cerium, gadolinium, neodymium, praseodymium, lanthanum and any combination thereof.

28. The method according to claim 1 including the step of abrading the aluminum or aluminum alloy surface prior to or during exposure to the aqueous solution.

29. A method of treating a surface of aluminum and alloys thereof to increase corrosion resistance by modification of the surface to inhibit cathodic processes, comprising;

providing an aqueous solution comprising a salt of at least one rare earth element selected from the group consisting of yttrium, gadolinium, cerium, europium, terbium, samarium, neodymium, praseodymium, lanthanum, holmium, ytterbium, dysprosium, erbium, and combinations thereof, but substantially exclusive of halides, said at least one rare earth being present in an amount of from about 2% by weight to saturation, the aqueous solution including a surfactant and a pH-modifying agent present in an amount effective to adjust the pH to from about 4.5 to an upper solubility limit of said salt of at least one rare earth element in said aqueous solution as a function of pH; and exposing a surface of said aluminum or alloy thereof to the aqueous solution, in a single step treatment, for an effective period of time and with the solution being at an effective temperature to modify said surface to inhibit cathodic processes but not to purposefully grow a thick protective oxide coating thereon.

30. The method according to claim 29 wherein the pH is adjusted to a value from about 4.5 to about 6.5, the effective temperature of the aqueous solution being in the range from about 75° C. to about 95° C., and wherein the surface is exposed to said aqueous solution for a period of time less than about one hour.

31. The method according to claim 30 wherein said salt is a nitrate and said at least one rare earth is selected from the group consisting of cerium, gadolinium, neodymium, praseodymium, lanthanum and any combination thereof.

32. The method according to claim 30 wherein said at least one rare earth is cerium.

33. The method according to claim 32 wherein said pH is adjusted to a value of about 5.5.

34. The method according to claim 32 wherein said aqueous solution comprises dissolved aluminum.

35. The method according to claim 34 wherein said aluminum originates from aluminum metal dissolved in said aqueous solution.

36. The method according to claim 29 including the step of abrading the aluminum or aluminum alloy surface prior to or during exposure to the aqueous solution.

* * * * *